US009132655B2

(12) United States Patent
Ito

(10) Patent No.: US 9,132,655 B2
(45) **Date of Patent: *Sep. 15, 2015**

(54) INK CARTRIDGE AND RECORDING DEVICE HAVING INK CARTRIDGE DETACHABLY MOUNTED THEREIN

(71) Applicant: Brother Kogyo Kabushiki Kaisha, Nagoya-shi, Aichi-ken (JP)

(72) Inventor: Noritsugu Ito, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/076,140

(22) Filed: Nov. 8, 2013

(65) Prior Publication Data

US 2014/0063152 A1 Mar. 6, 2014

Related U.S. Application Data

(63) Continuation-in-part of application No. PCT/JP2011/067208, filed on Jul. 28, 2011.

(30) Foreign Application Priority Data

May 9, 2011 (JP) ..... 2011-104633

(51) Int. Cl.

| | |
|---|---|
| ***B41J 2/175*** | (2006.01) |
| ***B41J 29/393*** | (2006.01) |
| ***B41J 29/02*** | (2006.01) |

(52) U.S. Cl.

CPC ..... *B41J 2/17553* (2013.01); *B41J 2/175* (2013.01); *B41J 2/1752* (2013.01); *B41J 2/17513* (2013.01); *B41J 2/17523* (2013.01); *B41J 2/17596* (2013.01); *B41J 29/02* (2013.01)

(58) Field of Classification Search

USPC ..... 347/7, 19, 49, 84, 85, 86, 87

See application file for complete search history.

(56) References Cited

U.S. PATENT DOCUMENTS

| | | | |
|---|---|---|---|
| 4,476,472 | A | 10/1984 | Aiba et al. |
| 5,929,884 | A | 7/1999 | Hetzer et al. |

(Continued)

FOREIGN PATENT DOCUMENTS

| | | | |
|---|---|---|---|
| CN | 1623788 | A | 6/2005 |
| CN | 1974223 | A | 6/2007 |

(Continued)

OTHER PUBLICATIONS

International Bureau, International Preliminary Report on Patentability for PCT Application No. PCT/JP2011/067208 (counterpart to above-captioned patent application), mailed Nov. 21, 2013.

(Continued)

*Primary Examiner* — Anh T. N. Vo

(74) *Attorney, Agent, or Firm* — Baker Botts L.L.P.

(57) ABSTRACT

An ink cartridge includes: a case; an ink accommodating unit; a moving body; a single detecting unit; and a storing unit. The ink accommodating unit is provided in the case and is configured to accommodate ink therein. The moving body is configured to move relative to the case. The single detecting unit is provided to the case and is configured to output a signal corresponding to a position of the moving body relative to the case. The storing unit is configured to store time length data indicative of a length of time to be taken by a value of the signal to change from a first prescribed value to a second prescribed value different from the first prescribed value.

7 Claims, 16 Drawing Sheets

(56) References Cited

U.S. PATENT DOCUMENTS

| | | | | |
|---|---|---|---|---|
| 5,963,237 | A | 10/1999 | Ikkatai et al. | |
| 5,988,802 | A | 11/1999 | Pawlowski, Jr. et al. | |
| 6,022,102 | A | 2/2000 | Ikkatai et al. | |
| 6,113,229 | A | 9/2000 | Gunther et al. | |
| 6,161,920 | A | 12/2000 | Santhanam et al. | |
| 6,164,743 | A | 12/2000 | Hmelar et al. | |
| 6,293,662 | B1 | 9/2001 | Shihoh et al. | |
| 6,332,676 | B1 | 12/2001 | Santhanam | |
| 6,378,971 | B1 | 4/2002 | Tamura et al. | |
| RE37,874 | E | 10/2002 | Pawlowski, Jr. et al. | |
| 6,457,805 | B2 | 10/2002 | Ohtani et al. | |
| 6,497,469 | B1 * | 12/2002 | Shinada et al. | 347/19 |
| 6,767,075 | B1 | 7/2004 | Takada et al. | |
| 7,458,667 | B2 * | 12/2008 | Kitabatake et al. | 347/86 |
| 7,871,155 | B2 | 1/2011 | Sasaki | |
| 8,011,767 | B2 | 9/2011 | Sugiyama et al. | |
| 8,033,629 | B2 * | 10/2011 | Asauchi | 347/14 |
| 8,317,306 | B2 | 11/2012 | Hattori | |
| 8,613,488 | B2 * | 12/2013 | Tomoguchi et al. | 347/7 |
| 2001/0024225 | A1 | 9/2001 | Ishizawa et al. | |
| 2002/0024543 | A1 | 2/2002 | Kimura et al. | |
| 2002/0089576 | A1 | 7/2002 | Ishizawa et al. | |
| 2002/0196317 | A1 | 12/2002 | Santhanam et al. | |
| 2003/0071874 | A1 | 4/2003 | Ishizawa et al. | |
| 2004/0201652 | A1 | 10/2004 | Katayama | |
| 2004/0252146 | A1 | 12/2004 | Naka et al. | |
| 2005/0068382 | A1 | 3/2005 | Kimura et al. | |
| 2005/0134663 | A1 | 6/2005 | Sasaki et al. | |
| 2005/0146577 | A1 | 7/2005 | Sasaki et al. | |
| 2005/0146578 | A1 | 7/2005 | Takagi et al. | |
| 2005/0146579 | A1 | 7/2005 | Sasaki et al. | |
| 2005/0151812 | A1 | 7/2005 | Sasaki et al. | |
| 2005/0195225 | A1 | 9/2005 | Takagi et al. | |
| 2005/0212874 | A1 | 9/2005 | Nomura et al. | |
| 2006/0007283 | A1 | 1/2006 | Sacco, Jr. et al. | |
| 2007/0008368 | A1 | 1/2007 | Maru et al. | |
| 2007/0120901 | A1 | 5/2007 | Sugiyama et al. | |
| 2007/0222829 | A1 | 9/2007 | Stathem | |
| 2007/0229618 | A1 | 10/2007 | Sugahara | |
| 2007/0285484 | A1 | 12/2007 | Sasaki | |
| 2008/0231676 | A1 | 9/2008 | Shimizu | |
| 2008/0259145 | A1 | 10/2008 | Nomura et al. | |
| 2008/0273048 | A1 | 11/2008 | Naka et al. | |
| 2008/0291251 | A1 | 11/2008 | Hattori | |
| 2008/0303879 | A1 | 12/2008 | Nip | |
| 2009/0021565 | A1 | 1/2009 | Hattori | |
| 2009/0085942 | A1 | 4/2009 | Asauchi | |
| 2009/0096849 | A1 | 4/2009 | Kanbe et al. | |
| 2009/0141106 | A1 | 6/2009 | Takagi | |
| 2009/0179974 | A1 | 7/2009 | Kimura | |
| 2009/0237426 | A1 | 9/2009 | Kimura | |
| 2009/0244166 | A1 | 10/2009 | Sugahara | |
| 2009/0322838 | A1 | 12/2009 | Wanibe et al. | |
| 2010/0079513 | A1 | 4/2010 | Taira et al. | |
| 2010/0155417 | A1 | 6/2010 | Utzui et al. | |
| 2010/0220127 | A1 | 9/2010 | Levy et al. | |
| 2010/0238241 | A1 | 9/2010 | Sasaki | |
| 2010/0245459 | A1 | 9/2010 | Kanbe et al. | |
| 2011/0000935 | A1 | 1/2011 | Iwamuro et al. | |
| 2011/0141167 | A1 | 6/2011 | Kikkawa et al. | |
| 2011/0187772 | A1 | 8/2011 | Tomoguchi et al. | |
| 2011/0242233 | A1 | 10/2011 | Hirano et al. | |
| 2011/0249065 | A1 | 10/2011 | Hirano et al. | |
| 2012/0069068 | A1 | 3/2012 | Ito et al. | |
| 2012/0075392 | A1 | 3/2012 | Shirono et al. | |
| 2013/0027480 | A1 | 1/2013 | Otobe | |
| 2014/0139584 | A1 * | 5/2014 | Chen et al. | 347/19 |
| 2014/0253628 | A1 | 9/2014 | Hirano et al. | |

FOREIGN PATENT DOCUMENTS

| | | | |
|---|---|---|---|
| CN | 101085576 | A | 12/2007 |
| CN | 101310986 | A | 11/2008 |
| EP | 0799703 | A2 | 10/1997 |
| EP | 0803364 | A2 | 10/1997 |
| EP | 0826505 | A2 | 3/1998 |
| EP | 1053881 | A1 | 11/2000 |
| EP | 1060895 | A1 | 12/2000 |
| EP | 1114725 | A2 | 7/2001 |
| EP | 1153752 | A2 | 11/2001 |
| EP | 1164025 | A1 | 12/2001 |
| EP | 1241011 | A2 | 9/2002 |
| EP | 1285764 | A1 | 2/2003 |
| EP | 1462263 | A2 | 9/2004 |
| EP | 1466739 | A1 | 10/2004 |
| EP | 1609604 | A1 | 12/2005 |
| EP | 1839876 | A1 | 10/2007 |
| EP | 2095961 | A1 | 9/2009 |
| EP | 2105306 | A2 | 9/2009 |
| EP | 2174788 | A1 | 4/2010 |
| EP | 2202078 | A1 | 6/2010 |
| EP | 2272675 | A2 | 1/2011 |
| GB | 2312283 | A | 10/1997 |
| JP | S60-092861 | A | 5/1985 |
| JP | H08-080618 | A | 3/1996 |
| JP | H10-044456 | A | 2/1998 |
| JP | H11-286123 | A | 10/1999 |
| JP | 2000-225692 | A | 8/2000 |
| JP | 2002154223 | A | 5/2002 |
| JP | 2004-050541 | A | 2/2004 |
| JP | 2005-238815 | A | 9/2005 |
| JP | 2005-306005 | A | 11/2005 |
| JP | 2009-255545 | A | 11/2009 |
| JP | 2010-017926 | A | 1/2010 |
| JP | 2010-069807 | A | 4/2010 |
| JP | 2010-076301 | A | 4/2010 |
| WO | 2005/075204 | A1 | 8/2005 |
| WO | 2008-117882 | A1 | 10/2008 |

OTHER PUBLICATIONS

European Patent Office, Extended European Search Report for European Patent Application No. 11737231.8 (related to related U.S. Appl. No. 13/016,854), mailed Oct. 7, 2013.

European Patent Office, Extended European Search Report for European Patent Application No. 11737232.6 (foreign counterpart to related U.S Appl. No. 13/016,854), mailed Oct. 7, 2013.

United States Patent and Trademark Office, Office Action for U.S. Appl. No. 13/016,860 (related to related U.S. Appl. No. 13/016,854), mailed Apr. 1, 2013.

United States Patent and Trademark Office, Office Action for U.S. Appl. No. 13/016,615 (counterpart to related U.S. Appl. No. 13/016,854), mailed Feb. 14, 2013.

Japan Patent Office, International Search Report for International Patent Application No. PCT/JP2011/052304 (foreign counterpart to related U.S. Appl. No. 13/016,854), mailed Apr. 5, 2011.

European Patent Office, extended European Search Report for European Patent Application No. 11152591.1 (foreign counterpart to related U.S. Appl. No. 13/016,854), mailed Jun. 30, 2011.

European Patent Office, extended European Search Report for European Patent Application No. 11152604.2 (foreign counterpart to related U.S. Appl. No. 13/016,854), mailed Mar. 4, 2011.

European Patent Office, partial European Search Report for European Patent Application No. 11152591.1 (foreign counterpart to related U.S. Appl. No. 13/016,854), mailed Mar. 4, 2011.

United States Patent and Trademark Office, Non-Final Office Action for U.S. Appl. No. 13/016,615 (related to related U.S. Appl. No. 13/016,854), mailed Dec. 21, 2012.

The International Bureau of WIPO, International Preliminary Report on Patentability for International Patent Application No. PCT/JP2011/052305, (foreign counterpart to related U.S. Appl. No. 13/016,854), mailed Aug. 9, 2012.

European Patent Office, extended European Search Report for European Patent Application No. 11152574.7 (foreign counterpart to related U.S. Appl. No. 13/016,854), mailed Jun. 29, 2011.

European Patent Office, partial European Search Report for European Patent Application No. 11152574.7 (foreign counterpart to related U.S. Appl. No. 13/016,854), mailed Mar. 1, 2011.

Japan Patent Office, International Search Report for International Patent Application No. PCT/JP2011/052305, (foreign counterpart to related U.S. Appl. No. 13/016,854), mailed Apr. 5, 2011.

(56) References Cited

OTHER PUBLICATIONS

Japan Patent Office, Written Opinion of the International Searching Authority for International Patent Application No. PCT/JP2011/052305, (foreign counterpart to related U.S. Appl. No. 13/016,854), mailed Apr. 5, 2011.
United States Patent and Trademark Office, Notice of Allowance issued for U.S. Appl. No. 13/016,854 (related to above-captioned patent application), mailed Aug. 7, 2013.
United States Patent and Trademark Office, Supplemental Notice of Allowance issued for U.S. Appl. No. 13/016,854 (related to above-captioned patent application), mailed Oct. 7, 2013.
United States Patent and Trademark Office, Non-Final Office Action issued for U.S. Appl. No. 13/016,860 (related to above-captioned patent application), mailed Apr. 1, 2013.
United States Patent and Trademark Office, Final Office Action issued for U.S. Appl. No. 13/016,860 (related to above-captioned patent application), mailed Oct. 7, 2013.
United States Patent and Trademark Office, Notice of Allowance issued for U.S. Appl. No. 13/016,860 (related to above-captioned patent application), mailed Feb. 19, 2014.
State Intellectual Property Office of the People's Republic of China, Notification of First Office action for Chinese Patent Application No. 201110035993.2 (submitted as reference in related U.S. Appl. No. 13/016,860), mailed Jan. 9, 2014.
State Intellectual Property Office of the People's Republic of China, Notification of First Office Action for Chinese Patent Application No. 201110036033.8 (submitted as reference in related U.S. Appl. No. 13/016,860), mailed Jan. 13, 2014.
State Intellectual Property Office of the People's Republic of China, Notification of First Office Action for Chinese Patent Application No. 201180007708.4 (foreign counterpart of related U.S. Appl. No. 13/016,860), mailed May 28, 2014.
United States Patent and Trademark Office, Non-Final Office Action issued for U.S. Appl. No. 13/016,615 (related to above-captioned patent application), mailed Dec. 21, 2012.
United States Patent and Trademark Office, Notice of Allowance issued for U.S. Appl. No. 13/016,615 (related to above-captioned patent application), mailed Sep. 3, 2013.
IP Australia, Patent Examination Report issued for Australian patent application No. 2011211308 (foreign counterpart of related U.S. Appl. No. 13/016,860), mailed Mar. 5, 2014.
State Intellectual Property of the People's Republic of China, Notification of First Office Action issued for Chinese Patent Application No. 201180007740.2 (foreign counterpart of related U.S. Appl. No. 13/016,854), mailed Apr. 22, 2014.
European Patent Office, Extended European Search Report issued for European Patent Application No. 11865271.8 (counterpart to above-captioned patent application), mailed Apr. 1, 2015.
United States Patent and Trademark Office, Non-Final Office Action issued for U.S. Appl. No. 14/283,200, mailed Mar. 18, 2015.

* cited by examiner

INK CARTRIDGE AND RECORDING DEVICE HAVING INK CARTRIDGE DETACHABLY MOUNTED THEREIN

CROSS REFERENCE TO RELATED APPLICATION

This application claims priority from Japanese Patent Application 2011-104633 filed May 9, 2011. This application is also a continuation-in-part of International Application No. PCT/JP2011/067208 filed Jul. 28, 2011 in Japan Patent Office as a Receiving Office. The contents of these applications are incorporated herein by reference.

TECHNICAL FIELD

The present invention relates to an ink cartridge and a recording device.

BACKGROUND

United States patent application publication No. US2005/0068382A1 describes an ink cartridge housing an ink bag. A valve is attached to the ink bag. When the user mounts the ink cartridge into the recording device, an ink supply needle provided in the recording device opens the ink bag valve, allowing ink in the ink bag to be supplied to the recording device through the ink supply needle.

United States patent application publication No. US2005/0212874A1 describes an inkjet printer, in which a subsidiary tank is provided between a main tank and an inkjet head. The subsidiary tank is for separating air from ink and for generating a desired pressure head difference between the inkjet head and the subsidiary tank.

SUMMARY

However, in the technology described in the publication No. US2005/0068382A1, if the user mounts the ink cartridge into the recording device quickly or abruptly, there occurs a sudden deceleration in the ink cartridge from a point during the mounting motion (while the ink cartridge is moving at a high velocity) to the point that mounting is completed (when the ink cartridge has come to a halt). Such a great deceleration of the ink cartridge applies a large force to the ink accommodated in the ink bag, producing a large change in ink pressure. This change in pressure is transmitted to the recording head, breaking the meniscus formed in nozzles formed in the recording head and, hence, allowing ink to leak from the nozzles. If printing is resumed in this state, the recording head may not attain desired ink ejection characteristics.

In addition, if the subsidiary tank is provided between the inkjet print head and an ink cartridge, such a great deceleration of the ink cartridge may cause ink to flow from the ink cartridge into the subsidiary tank. The height of the liquid surface of the ink in the subsidiary tank may change and the pressure head difference between the subsidiary tank and the inkjet head will go beyond a desirable range. The negative pressure applied to ink within the nozzles will go beyond a desirable range. If printing is resumed in this state, the recording head may not attain desired ink ejection characteristics.

In view of the foregoing, it is an object of the present invention to provide an ink cartridge and a recording device, which are capable of maintaining ejection characteristics of a recording head at a desirable state even when the ink cartridge is mounted in the recording device with a high speed.

In order to attain the above and other objects, the invention provides an ink cartridge including: a case; an ink accommodating unit; a moving body; a single detecting unit; and a storing unit. The ink accommodating unit is provided in the case and is configured to accommodate ink therein. The moving body is configured to move relative to the case. The single detecting unit is provided to the case and is configured to output a signal corresponding to a position of the moving body relative to the case. The storing unit is configured to store time length data indicative of a length of time to be taken by a value of the signal to change from a first prescribed value to a second prescribed value different from the first prescribed value.

According to another aspect, the present invention provides a recording device including: a recording head configured to eject ink therefrom; an ink cartridge; a mounting unit configured such that the ink cartridge is detachably mounted thereto. The ink cartridge includes: a case; an ink accommodating unit provided in the case and configured to accommodate ink therein; a moving body configured to move relative to the case; and a single detecting unit provided to the case and configured to output a signal corresponding to a position of the moving body relative to the case. The recording device includes: a storing unit configured to store time length data indicative of a length of time to be taken by a value of the signal to change from a first prescribed value to a second prescribed value different from the first prescribed value. The mounting unit includes a moving unit configured to move the moving body relative to the case when the ink cartridge is moving relative to the mounting unit so as to be mounted in the mounting unit. The detecting unit outputs a signal indicative of the first prescribed value when the moving body reaches a first position defined in the case, and outputs a signal indicative of the second prescribed value when the moving body reaches a second position different from the first position. The recording device further includes: a calculating unit configured to calculate a length of time taken by the value of the signal to change from the first prescribed value to the second prescribed value; a comparing unit configured to compare the calculated length of time with the length of time indicated by the stored time length data; an ink discharging mechanism configured to forcibly eject ink from the recording head; and a control unit configured to control the ink discharging mechanism based on a comparing result by the comparing unit.

BRIEF DESCRIPTION OF THE DRAWINGS

In the drawings:

FIG. 3(A) and FIG. 3(B) are perspective views of a maintenance unit, in which FIG. 3(A) shows the configuration of caps and inner frame parts of the maintenance unit, and FIG. 3(B) shows an outer frame of the maintenance unit;

FIG. 4(A)-FIG. 4(C) are partial side views of the inkjet printer for illustrating a capping operation, wherein FIG. 4(A) shows the state where the inkjet heads are moved from the printing position to a retracted position, while caps are in an initial position, FIG. 4(B) shows the state where the caps are moved in a sub scanning direction to be in confrontation with ejection surfaces of the inkjet heads, and FIG. 4(C) shows the state where the caps are moved, to a capping position covering the ejection surfaces of the inkjet heads;

FIG. 9(A) and FIG. 9(B) are graphs showing how the output of a magnetic sensor changes as the detected portion of the second value moves, wherein FIG. 9(A) shows the relationship between the magnetic sensor output and the position of the detected portion in the main scanning direction, and FIG. 9(B) shows the relationship between the magnetic sensor output and time;

FIG. 11(A) and FIG. 11(B) are partial cross-sectional views showing the state how the ink cartridge is mounted in a mounting unit of the printer, wherein FIG. 11(A) shows the state prior to when the ink cartridge is mounted in the mounting unit, and FIG. 11(B) shows the state of when the ink cartridge is mounted in the mounting unit;

FIGS. 15(A) and 15(B) are partial cross-sectional views of an ink cartridge according to a modification, wherein FIG. 15(A) shows the state when a second valve is closed; and FIG. 15(B) shows the state when the second valve is open.

DETAILED DESCRIPTION

Next, embodiments of the present invention will be described while referring to the accompanying drawings.

First Embodiment

Figure 1:
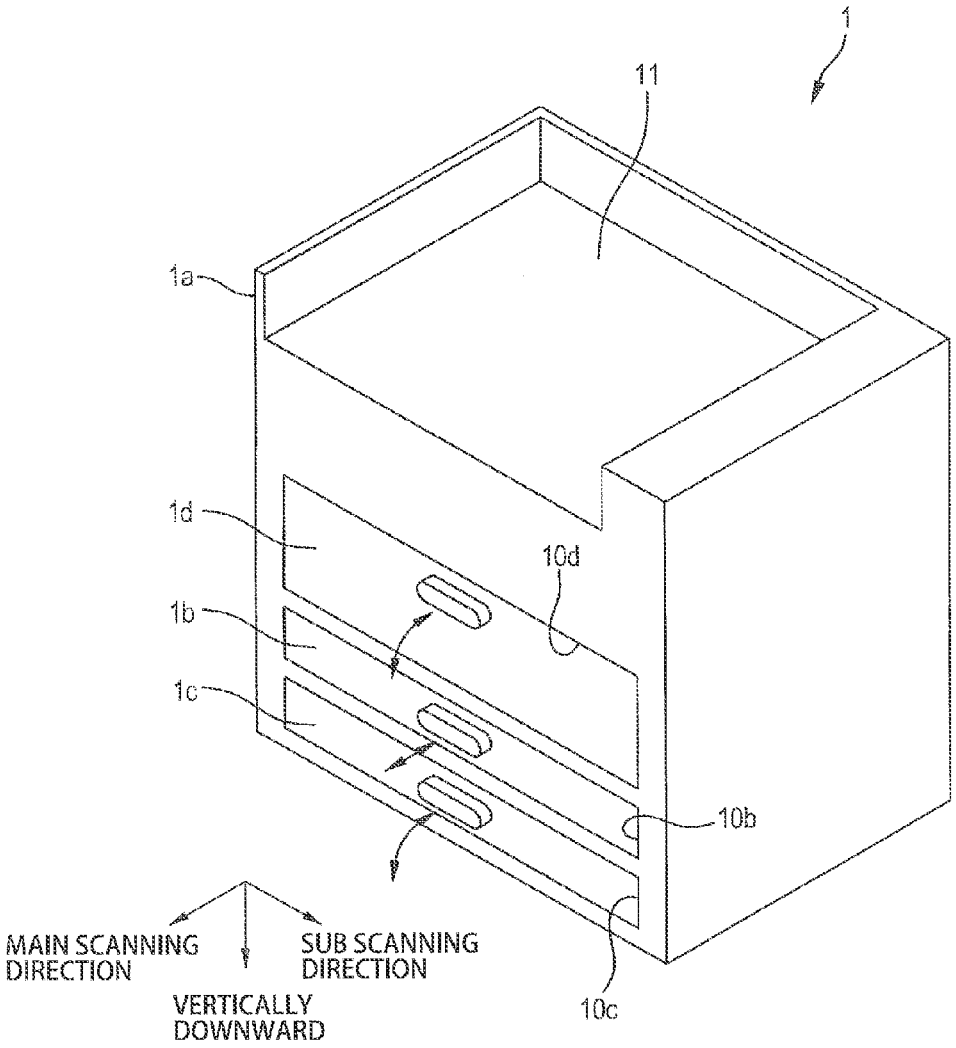
FIG. 1 is a perspective view showing the external appearance of an inkjet printer according to a first embodiment of the present invention.

As shown in FIG. 1, an inkjet printer 1 according to a first embodiment of the present invention has a casing 1*a* formed in the shape of a rectangular parallelepiped. Three openings 10*d*, 10*b*, and 10*c* are formed in order from top to bottom in the front surface of the casing 1*a* (the surface on the near side in FIG. 1). Doors 1*d* and 1*c* are disposed in the openings 10*d* and 10*c*, respectively, so as to be flush with the front surface of the casing 1*a*. The doors 1*d* and 1*c* can be opened and closed about a horizontal axis passing through their respective lower edges. A paper supply unit 1*b* is inserted into the opening 10*b*. A paper discharging unit 11 is provided on the top of the casing 1*a*. The door 1*d* is disposed facing the conveying unit 21 with respect to a main scanning direction of the casing 1*a* (a direction toward the near side in FIG. 1).

Figure 2A:
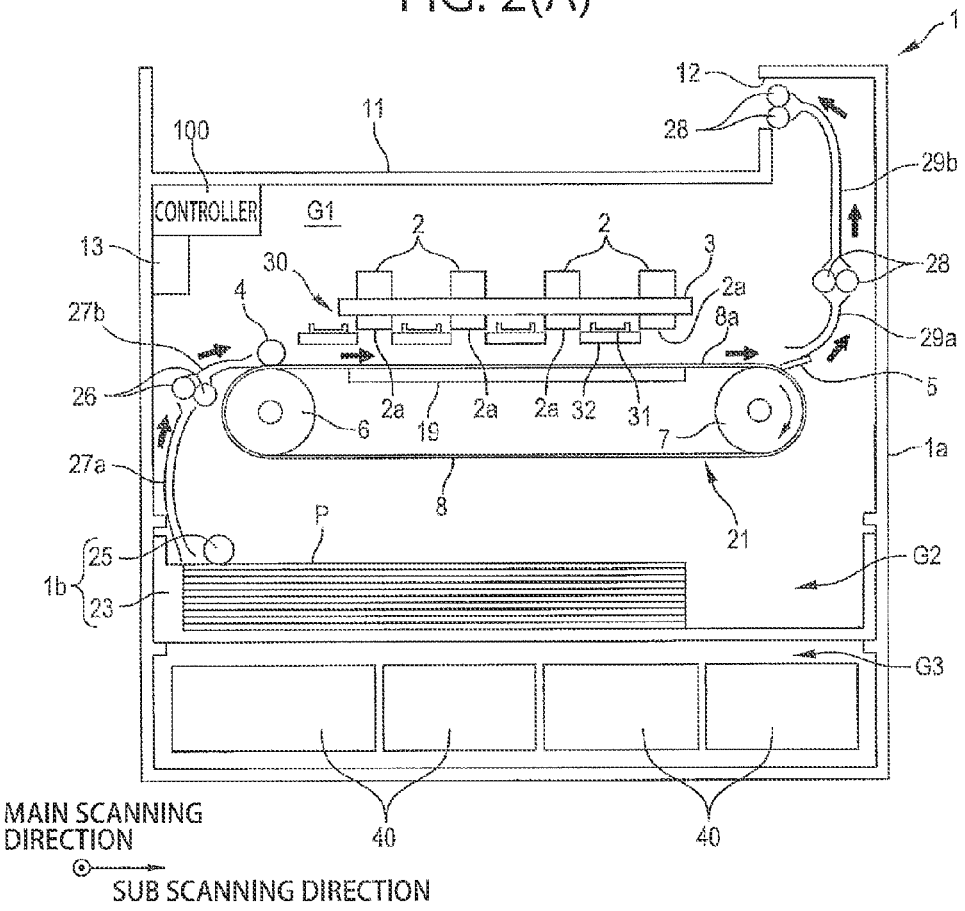
FIG. 2(A) is a side cross-sectional view showing the internal structure of the inkjet printer in FIG. 1, in which inkjet heads are in a printing position.
Figure 2B:
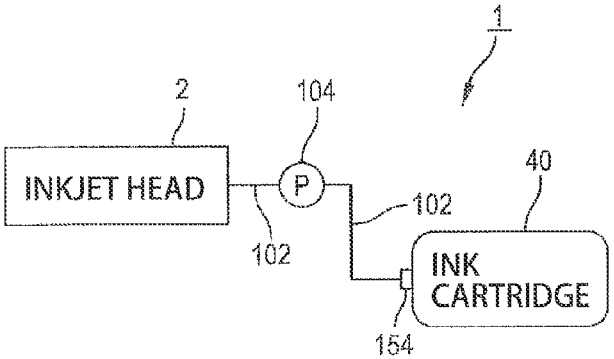
FIG. 2(B) is a schematic diagram showing an ink supplying system of the inkjet printer in FIG. 1.

Next, the internal structure of the inkjet printer 1 will be described with reference to FIG. 2(A) and FIG. 2(B). As shown in FIG. 2(A), the interior of the casing 1*a* is partitioned into three spaces G1-G3 in order from top to bottom. Within the space G1 are disposed four inkjet heads 2 (recording heads) that eject ink in the respective colors magenta, cyan, yellow, and black; a maintenance unit 30 (maintenance mechanism/ink discharging mechanism); and the conveying unit 21. The paper supply unit 1*b* is disposed in the space G2, and four ink cartridges 40 are disposed in the space G3.

The paper supply unit 1*b* and the four ink cartridges 40 are mounted in and removed from the casing 1*a* along the main scanning direction (the direction orthogonal to the surface of the paper in FIG. 2(A)). In the embodiment, a sub scanning direction is a direction parallel to a direction in which a sheet P is conveyed by the conveying unit 21, while the main scanning direction is a horizontal direction orthogonal to the sub scanning direction. The inkjet printer 1 is further provided with a controller 100 that controls the paper supply unit 1*b*, maintenance unit 30, conveying unit 21, and inkjet heads 2.

The four inkjet heads 2 are supported in the casing 1*a* by means of a frame 3 and are juxtaposed in the sub scanning direction. Each inkjet head 2 is elongated in the main scanning direction. In other words, the inkjet printer 1 of the embodiment is a line-type color inkjet printer. An elevating mechanism (not shown) is also provided for moving the frame 3 vertically within the casing 1*a*. The controller 100 controls the elevating mechanism to move the inkjet heads 2 between a printing position (the position shown in FIG. 2(A)) and a retracted position (see FIG. 4(A)) higher than the printing position.

Each inkjet head 2 has a laminated body formed by bonding a channel unit and a plurality of actuators (both not shown in the drawings) together. The channel unit has a plurality of ink channels and a plurality of pressure chambers formed therein, and the actuators apply pressure to ink in the pressure chambers. The bottom surface of each inkjet head 2 is an ejection surface 2*a*. A plurality of ejection holes (not shown) for ejecting ink from the plurality of pressure chambers are formed in each ejection surface 2*a*.

The bold arrows in FIG. 2(A) indicate a paper-conveying path formed in the inkjet printer 1 along which sheets P are conveyed from the paper supply unit 1*b* to the paper discharging unit 11. The paper supply unit 1*b* includes a paper tray 23 capable of accommodating a plurality of sheets P, and a feeding roller 25 mounted on the paper tray 23. When a drive force is applied to the feeding roller 25 by a feeding motor (not shown) controlled by the controller 100, the feeding roller 25 feeds the topmost sheet P accommodated in the paper tray 23. The sheet P fed by the feeding roller 25 is guided along guides 27*a* and 27*b*, and a pair of conveying rollers 26 grip and convey the sheet P to the conveying unit 21.

As shown in FIG. 2(A), the conveying unit 21 includes two belt rollers 6 and 7 and an endless conveying belt 8 looped around both belt rollers 6 and 7 and stretched taut therebetween. The belt roller 7 is a drive roller that is rotated clockwise in FIG. 2(A) when the controller 100 controls a conveying motor (not shown) to apply a drive force to a shaft of the belt roller 7. The belt roller 6 is a follow roller that also rotates clockwise in FIG. 2(A) when the conveying belt 8 is circulated by the rotating belt roller 7.

An outer surface 8*a* of the conveying belt 8 is coated with silicone to) give the outer surface 8*a* tackiness. A nip roller 4 is disposed along the paper-conveying path at a position confronting the belt roller 6 through the conveying belt 8. The nip roller 4 holds the sheet P conveyed from the paper supply unit 1*b* against the outer surface 8*a* of the conveying belt 8. Once pressed against the outer surface 8*a*, the sheet P is conveyed rightward in FIG. 2(A) (in the paper-conveying direction) while being held on the outer surface 8*a* by the tacky coating.

A separating plate 5 is also disposed on the paper-conveying path at a position opposing the belt roller 7 through the conveying belt 8. The separating plate 5 functions to separate the sheet P from the outer surface 8*a* of the conveying belt 8. Once separated, the sheet P is guided toward pairs of conveying rollers 28 by guides 29*a* and 29*b*, and the conveying rollers 28 grip and discharge the sheet P onto the paper discharging unit 11 through an opening 12 formed in the top of the casing 1*a*. A feeding motor (not shown) controlled by the controller 100 applies a drive force to one of the conveying rollers 28 in each pair.

A platen 19 having a substantially rectangular parallelepiped shape is disposed within the loop of the conveying belt 8 at a position opposite the four inkjet heads 2. The top surface of the platen 19 contacts the inner surface of the conveying belt 8 on the upper portion of the loop and supports this upper loop portion from the inner surface of the conveying belt 8. Accordingly, the outer surface 8*a* on the upper loop portion of the conveying belt 8 is maintained parallel and opposite the ejection surfaces 2*a*, with a slight gap formed between the ejection surfaces 2*a* and the outer surface 8*a*. This gap constitutes part of the paper-conveying path. As a sheet P held on the outer surface 8*a* of the conveying belt 8 is conveyed directly beneath the four inkjet heads 2 in sequence, the inkjet heads 2 are controlled by the controller 100 to eject ink of their respective colors onto the top surface of the sheet P, thereby forming a desired color image on the sheet P.

Of the four ink cartridges 40, the leftmost ink cartridge 40 shown in FIG. 2(A) stores black ink. As shown in FIG. 2(A), the leftmost ink cartridge 40 has a larger dimension in the sub scanning direction than the other three ink cartridges 40 and, hence, a greater ink capacity than the other three ink cartridges 40. The remaining three ink cartridges 40 possess an identical ink capacity and store ink in the colors magenta, cyan, and yellow, respectively.

To replace one of the ink cartridges 40, the operator opens the door 1*c* on the casing 1*a*, removes the ink cartridge 40 from the printer body, and mounts a new ink cartridge 40 in the printer body. Although the ink cartridges 40 are mounted individually in the printer body in the embodiment, the four ink cartridges 40 may instead be placed in a single cartridge tray to form an ink unit, and the entire ink unit can be mounted in the printer body.

Next will be described ink supplying systems provided in the inkjet printer 1. Four ink supplying systems are provided for the four inkjet print heads 2, respectively. One of the ink supplying systems will be described below while referring to FIG. 2(B), but the following description is in common to the other ink supplying systems.

In each ink supplying system, one inkjet head 2 is connected via a flexible tube 102 (ink supplying path) to one ink supply channel 154 described later (see FIG. 11). The ink channels formed in the inkjet head 2 are in fluid communication with the flexible tube 102. A pump 104 (ink discharging mechanism, ink forcibly supplying unit) is provided in the midway portion of the tube 102. When one ink cartridge 40 is mounted in the body of the printer (the casing 1*a*), the ink cartridge 40 is connected to one ink supply channel 154 so that ink can be supplied from the ink cartridge 40 to the corresponding inkjet head 2. The pump 104 is for forcibly supplying ink from the ink cartridge 40 to the inkjet head 2. This pump 104 is included in a maintenance unit 30 to be described later.

As shown in FIG. 2(A), the maintenance unit 30 (maintenance mechanism) is provided between the four inkjet heads 2 and the conveying unit 21. The maintenance unit 30 functions to resolve ejection failures in the inkjet heads 2. The maintenance unit 30 includes four plate-shaped members 32 disposed at equal intervals along the sub scanning direction, and four caps 31 fixed to respective plate-shaped members 32 and being capable of covering the ejection surfaces 2*a* of the respective inkjet heads 2.

Figure 3A:
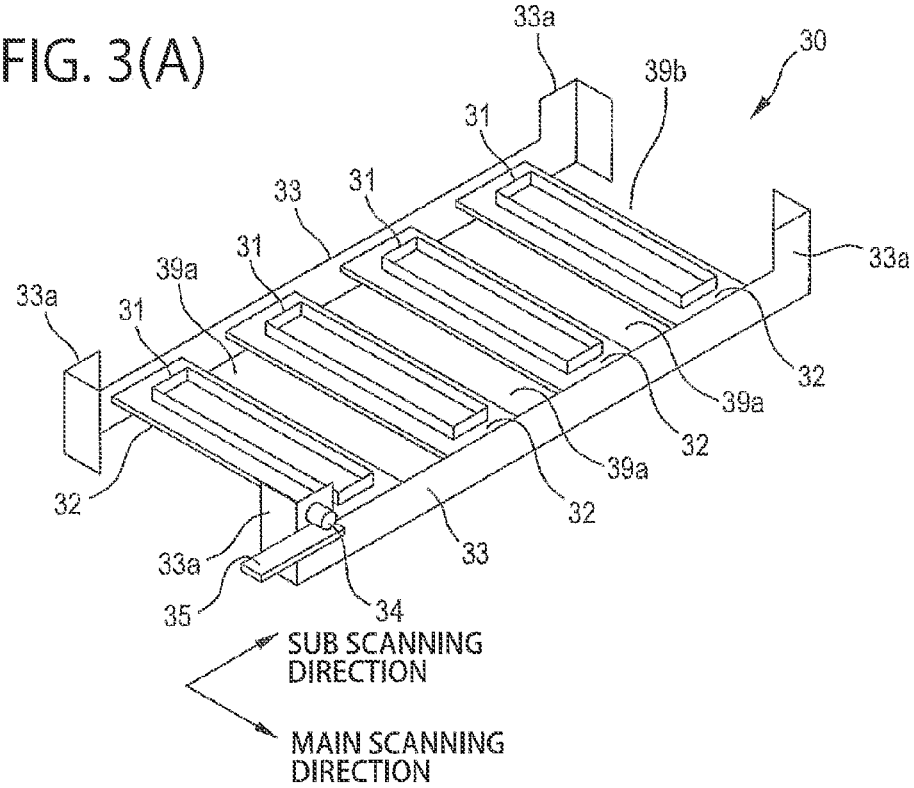

As shown in FIG. 3(A), the caps 31 are elongated in the main scanning direction, with their longitudinal dimension oriented parallel to the longitudinal dimension of the inkjet heads 2. The caps 31 are formed of an elastic material, such as rubber, and have a recessed part opened to the top. In their initial state, the four caps 31 are disposed upstream of their corresponding inkjet heads 2 with respect to the paper-conveying direction. More specifically, the cap 31 positioned farthest upstream is disposed upstream of the inkjet head 2 positioned farthest upstream, and the remaining three caps 31 are disposed between adjacent pairs of inkjet heads 2. As the maintenance unit 30 is moved, the four caps 31 move upwardly/downwardly and rightwardly/leftwardly in FIG. 2(A) with respect to the corresponding inkjet heads 2.

As shown in FIG. 3(A), the maintenance unit 30 also has a pair of inner frame parts 33 holding the plate-shaped members 32 therebetween. Each of the inner frame parts 33 has corner parts 33*a* protruding upward from both ends thereof. Pinion gears 34 fixed to the shafts of drive motors (not shown) controlled by the controller 100 are provided respectively on one corner part 33*a* of each inner frame part 33 for engaging with respective rack gears 35 arranged horizontally. Note that only one of the pinion gears 34 (on the near-side inner frame part 33) is shown in FIG. 3(A).

Figure 3B:
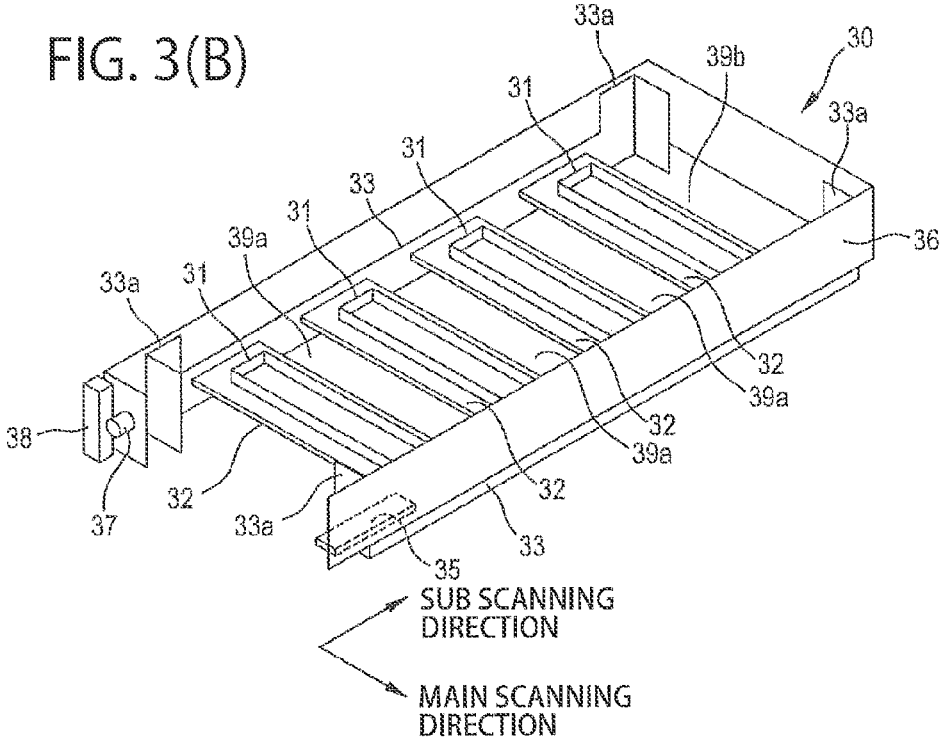

As shown in FIG. 3(B), the maintenance unit 30 also has an outer frame 36 disposed around the pair of inner frame parts 33. The rack gears 35 shown in FIG. 3(A) (only one is shown in FIG. 3(A)) are fixed to the inside of the outer frame 36. In addition, a pinion gear 37 fixed to the shaft of a drive motor (not shown) controlled by the controller 100 is also provided on the outer frame 36 for engaging with a rack gear 38 arranged vertically. The rack gear 38 is provided on the inner surface of the casing 1*a*.

With this construction, the controller 100 can control the pair of inner frame parts 33 to move along the sub scanning direction by rotating the two pinion gears 34 in synchronization. The controller 100 can also control the outer frame 36 to move along the vertical by rotating the pinion gear 37.

Figure 4A:
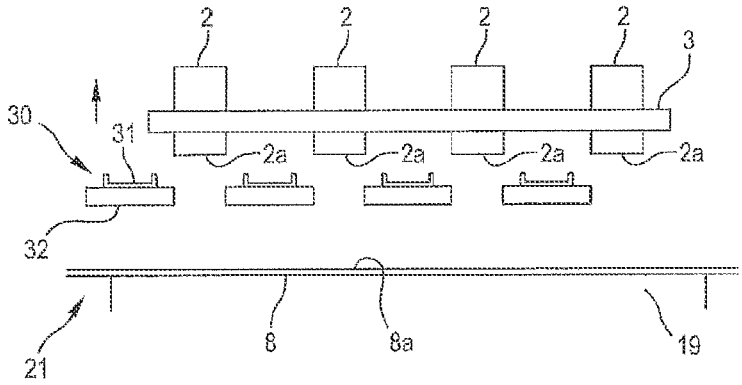

More specifically, when the maintenance unit 30 is in its initial position shown in FIG. 2(A), three openings 39*a* between pairs of adjacent plate-shaped members 32 and an opening 39*b* between the plate-shaped member 32 positioned farthest downstream and the corner parts 33*a* on the downstream side respectively oppose the ejection surfaces 2*a*. When a capping operation for covering the ejection surfaces 2*a* with the caps 31 is initiated from this initial state, the elevating mechanism moves the inkjet heads 2 from the printing position to the retracted position, as illustrated in FIG. 4(A).

Figure 4B:
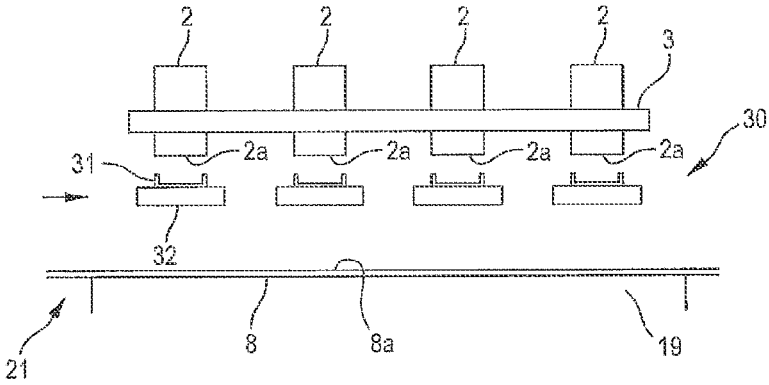
Figure 4C:
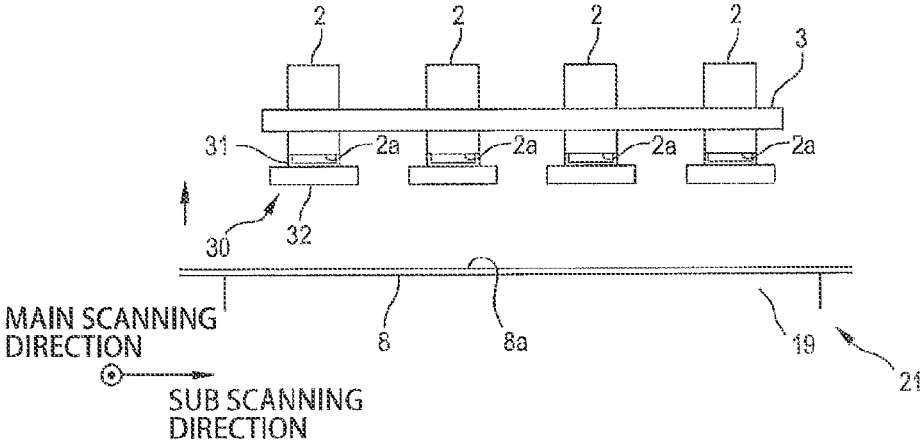

Next, the inner frame parts 33 are moved downstream in the paper-conveying direction until the caps 31 are positioned directly opposite the corresponding ejection surfaces 2*a*, as illustrated in FIG. 4(B). Next, the outer frame 36 is lifted vertically to a capping position in which the caps 31 are pressed against and cover the ejection surfaces 2*a*, as illustrated in FIG. 4(C). Through these steps, each of the caps 31 now covers a corresponding ejection surface 2*a*. When the steps are performed in reverse, the caps 31 can be returned to their initial position, and the inkjet heads 2 to the printing position.

Figure 5:
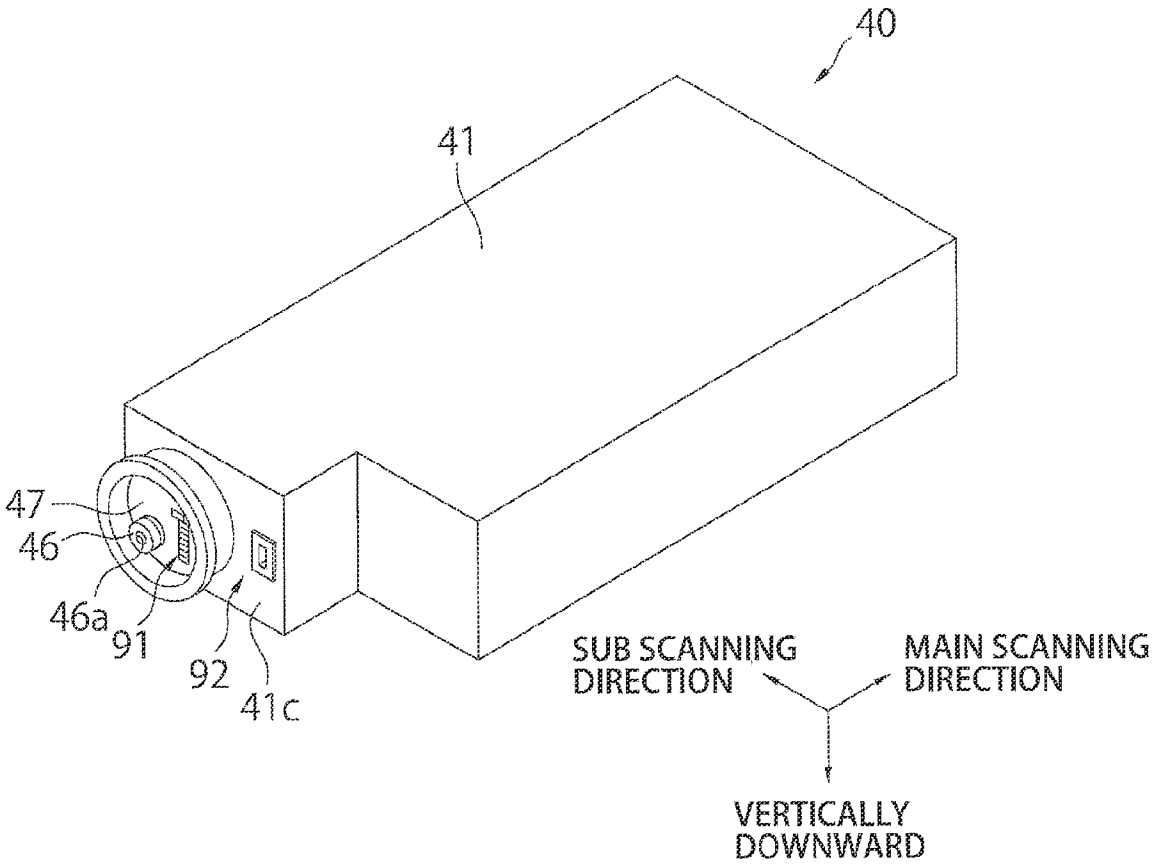
FIG. 5 is a perspective view of an ink cartridge according to the first embodiment of the present invention.
Figure 6:
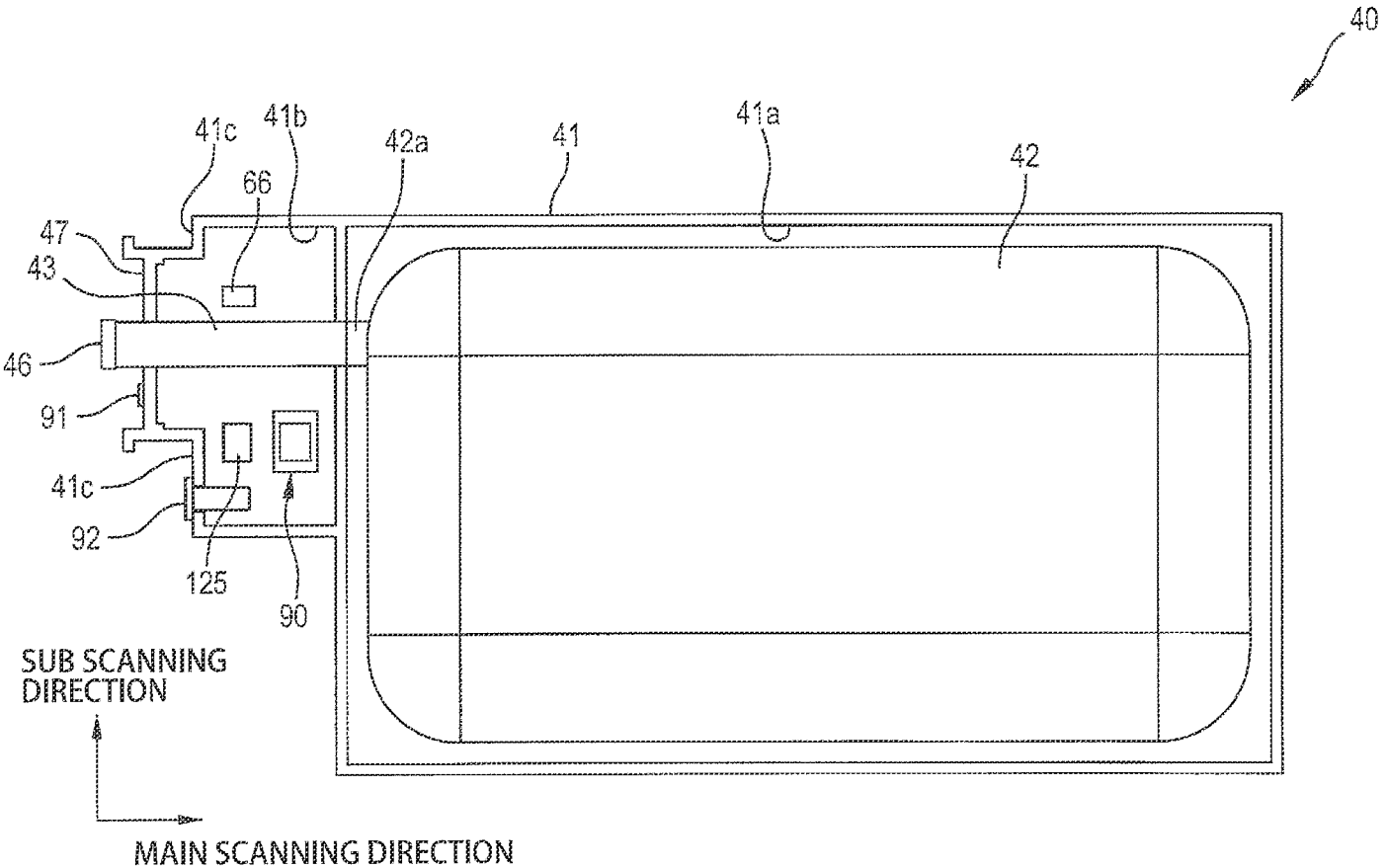
FIG. 6 is a schematic diagram showing the internal structure of the ink cartridge in FIG. 5.

Next, the ink cartridges 40 will be described with reference to FIG. 5 through FIG. 10. Note that the bold lines in FIG. 10 indicate power supply lines, while the normal lines indicate signal lines. As shown in FIG. 5, each ink cartridge 40 includes a case 41 having a substantially parallelepiped shape. As shown in FIG. 6, inside the case 41 are provided: an ink bag 42 (ink accommodating unit) that is filled with ink; an ink delivery tube 43 (ink delivery path) in communication with the ink bag 42 on one end; a controller 90; and a magnetic sensor 66 (detecting unit) and a storage unit 125 which are connected to the controller 90.

As shown in FIG. 6, the interior of the case 41 is partitioned into two chambers 41*a* and 41*b*. The ink bag 42 is provided in the chamber 41*a* on the right in FIG. 6, while the ink delivery tube 43, magnetic sensor 66, controller 90, and storage unit 125 are disposed in the other chamber 41*b*. An air communication through-hole (not shown) is formed through the case 41 to communicate the interior of the case 41 to the outside. With this configuration, the ink bag 42 is applied with an atmospheric pressure. So, when the ink cartridge 40 is mounted in the inkjet printer 1, ink in the inkjet head 2 is applied with a negative pressure that is generated due to the pressure head difference between the inkjet head 2 and the ink bag 42.

As mentioned earlier, the ink cartridge 40 for accommodating black ink is larger in size and has greater ink storage capacity than the other three ink cartridges 40, but this difference is simply reflected in the chamber 41*a* and ink bag 42 being larger in the sub scanning direction. Since the four ink cartridges 40 have essentially the same structure, only one of the ink cartridges 40 will be described below.

Figure 7A:
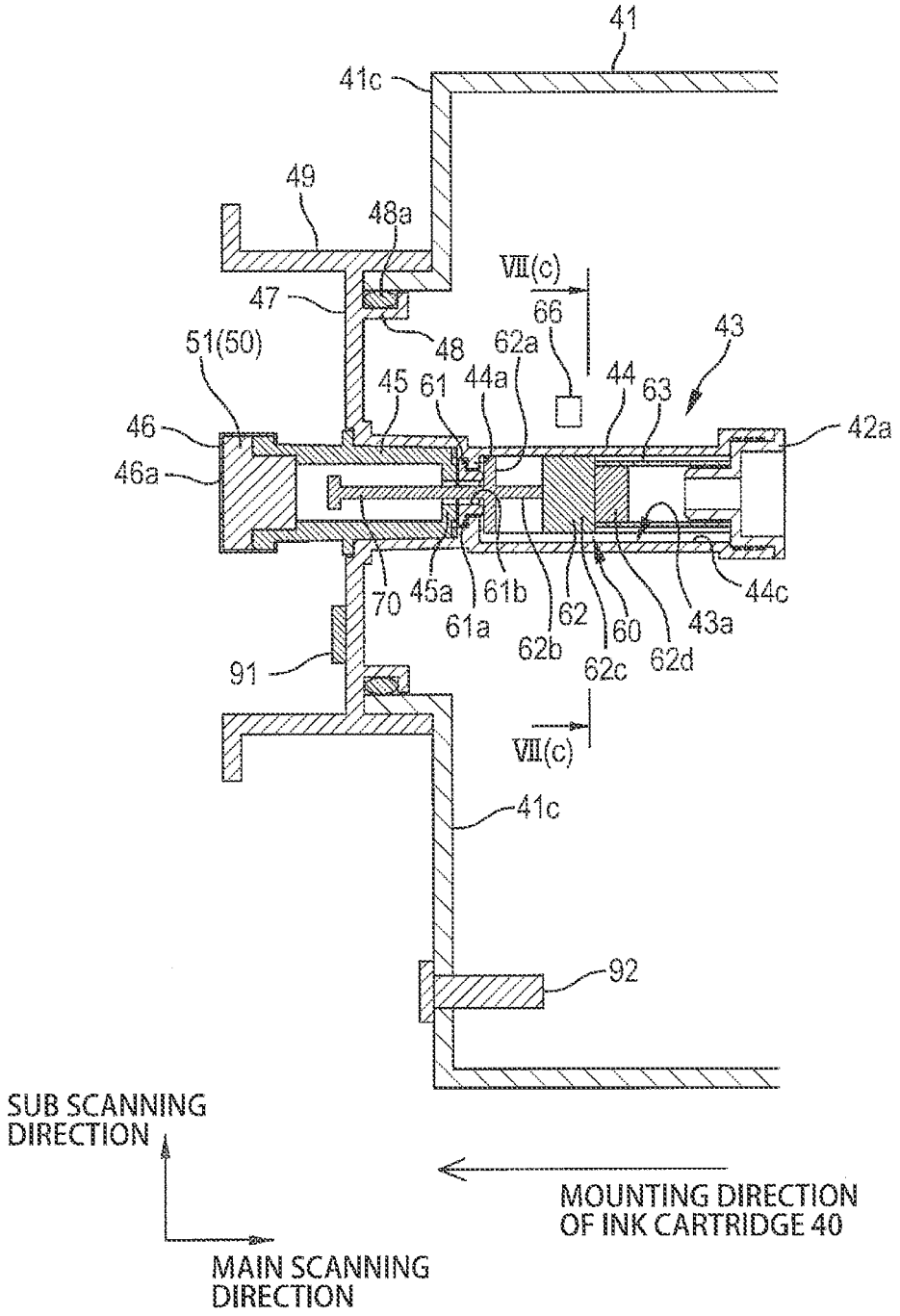
FIG. 7(A) is a partial cross-sectional view of the ink cartridge when first and second valves are closed.

As shown in FIG. 7(A), an ink channel 43*a* (ink delivery path) is formed inside the ink delivery tube 43. The ink channel 43*a* extends in the main scanning direction and is in communication with the ink bag 42. The ink delivery tube 43 includes a tube 44 and a tube 45. Both of the tubes 44 and 45 extend in the main scanning direction. The tube 44 is connected to a connector 42*a* provided on the ink bag 42. A groove 44*c* (FIG. 7(C)) extending in the main scanning direction is formed on the inner surface of the tube 44, establishing the ink channel 43*a*. The tube 45 is fitted into one end (left end) of the tube 44. In the embodiment, both the tubes 44 and 45 are constructed of a non-magnetic body (resin, for example). A cover 46 is provided over one end of the tube 45. An ink outlet 46*a* is formed in the cover 46.

As shown in FIG. 5-FIG. 7(A), a flange 47 is formed on one end of the tube 44. As shown in FIG. 7(A), the flange 47 is formed with a circular cylinder part 49 surrounding the outer periphery of the flange 47. The flange 47 is further formed with an annular protrusion 48 which is provided with an O-ring 48*a*. With this construction, the O-ring 48*a* seals the gap between the case 41 and annular protrusion 48. The flange 47 of the embodiment serves as part of the wall defining the chamber 41*b*.

A contact point 91 is formed on the outer surface of the flange 47. The contact point 91 is juxtaposed with the ink outlet 46*a* along the sub scanning direction. The contact point 91 is connected to the controller 90. As a variation of the embodiment, the contact point 91 can be disposed at any position, provided that the contact point 91 is not positioned vertically below the ink outlet 46*a*. Disposing the contact point 91 of the signal transmission system at a position that is not directly beneath the ink outlet 46*a* can prevent ink dripping out of the ink outlet 46*a* from depositing on the contact point 91.

Figure 10:
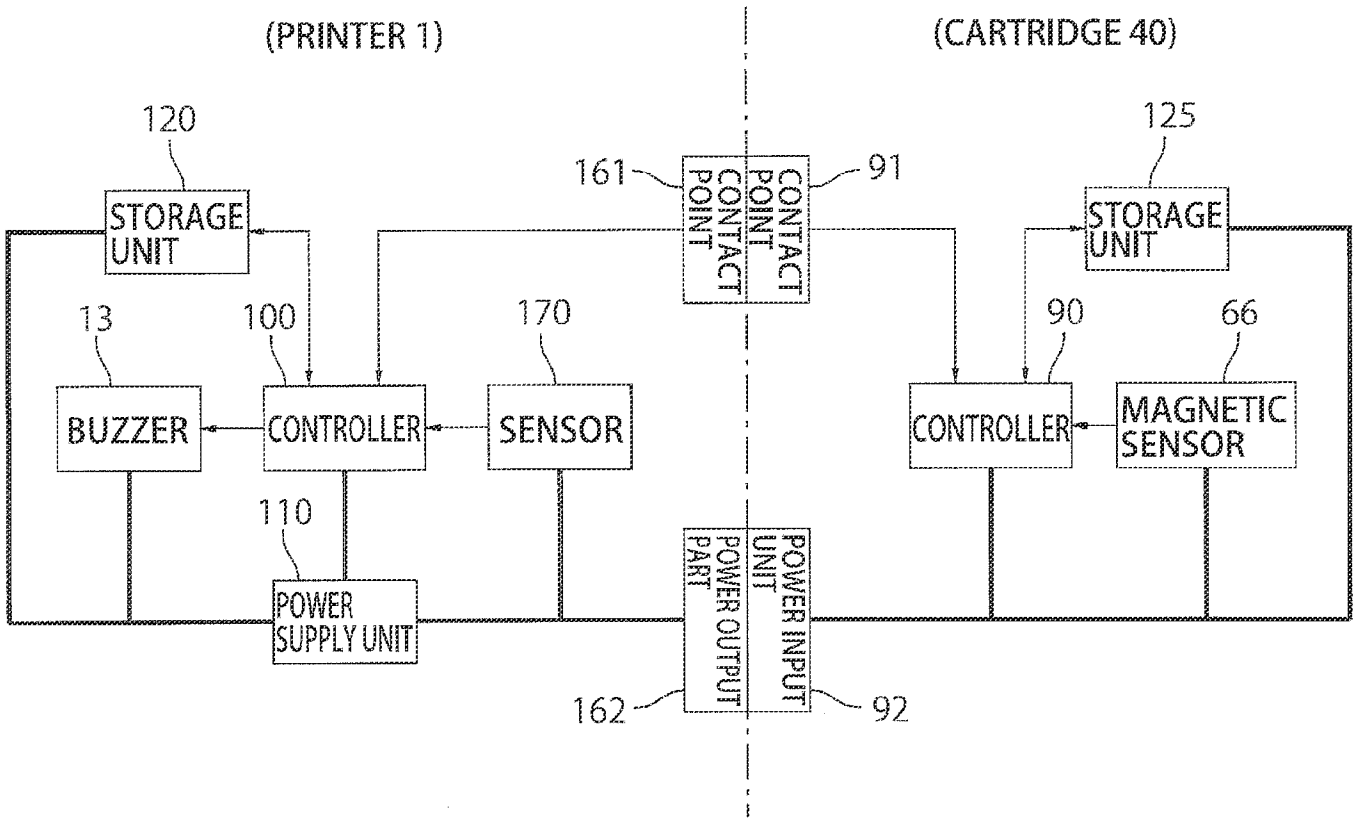
FIG. 10 is a block diagram showing the electrical structure of the inkjet printer and ink cartridge.

In addition, a power input unit 92 is disposed on a side surface of the case 41 on the ink outlet 46*a* side. A stepped surface 41*e* is formed on the case 41 so that the case 41 is recessed from the flange 47 toward the ink bag 42 in the main scanning direction between the ink outlet 46*a* and the power input unit 92. The power input unit 92 is provided on the stepped surface 41*c* and is positioned on the opposite side of the ink outlet 46*a* with respect to the contact point 91 in the sub scanning direction. In other words, the power input unit 92 is separated farther from the ink outlet 46*a* in the sub scanning direction than is the contact point 91. As shown in FIG. 10, the power input unit 92 is electrically connected to the controller 90 and the magnetic sensor 66. Through an electrical connection with a power output part 162 to be described later, the power input unit 92 supplies electricity to the controller 90 and the magnetic sensor 66. As a variation of the embodiment, the power input unit 92 may be disposed at any position, provided that the position is not directly beneath the ink outlet 46*a*.

Disposing the power input unit 92 of the power transmission system at a position not directly beneath the ink outlet 46*a* in this way prevents ink dripping out of the ink outlet 46*a* from depositing on the power input unit 92. Further, by separating the power input unit 92 from the ink outlet 46*a* even farther than the contact point 91, it is even less likely that ink will become deposited on the power input unit 92, thereby ensuring that the power input unit 92 does not short-circuit and damage the controller 90 or the like. Further, by forming the stepped surface 41*c* between the power input unit 92 and ink outlet 46*a*, the power input unit 92 and ink outlet 46*a* are separated considerably in the main scanning direction as well as the sub scanning direction, thereby further ensuring that ink does not become deposited on the power input unit 92.

As shown in FIG. 7(A), a first valve 50 is disposed in the tube 45 of the ink delivery tube 43. The first valve 50 includes a sealing member 51 (elastic body) for sealing the opening (ink delivery opening) formed in one end (left end in the figure) of the tube 45. The sealing member 51 is configured of an elastic material such as rubber or the like. The cover 46 provided to the one end of the tube 45 prevents the sealing member 51 from coming out of the tube 45.

Figure 7B:
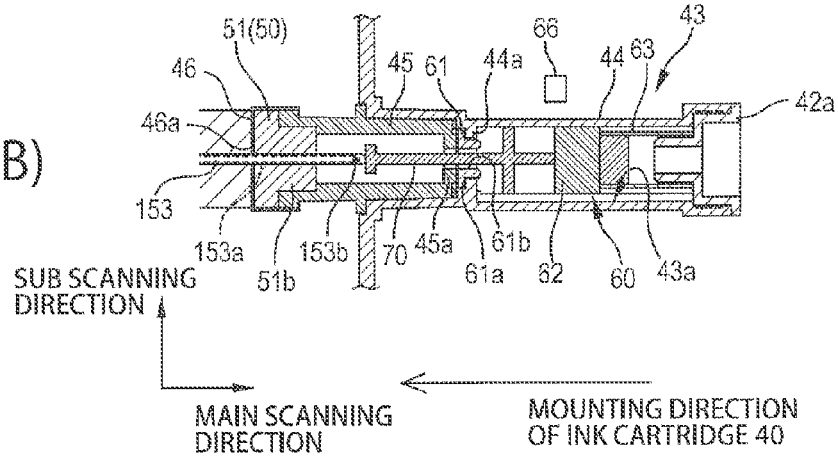
FIG. 7(B) is a partial cross-sectional view of the ink cartridge when the first and second valves are open.

When the ink cartridge 40 is mounted to the printer 1, a hollow needle 153 (hollow tube, moving unit) to be described later passes through the ink outlet 46*a* and penetrates the sealing member 51, as illustrated in FIG. 7(B). As a result, the first valve 50 changes from a closed state to an open state. As described later, a hole 153*b* is formed near to the distal end of the hollow needle 153. When the hole 153*b* passes through the sealing member 51, the hollow needle 153 and ink channel 43*a* communicates with each other. Conversely, when the hollow needle 153 is removed from the sealing member 51, the communication between the hollow needle 153 and ink channel 43*a* is interrupted. It is noted that when the hollow needle 153 penetrates the sealing member 51, a hole is formed in the sealing member 51. However, when the hollow needle 153 is removed from the sealing member 51, this hole is closed by elasticity of rubber constituting the sealing member 51. Therefore, the first valve 50 changes from the open state to the closed state. Thus, according to insertion/removal of the hollow needle 153, the first valve 50 enters into one of the open state in which the ink delivery tube 43 and hollow needle 153 communicate with each other and closed state in which the communication between the ink delivery tube 43 and hollow needle 153 is interrupted.

A second valve 60 is disposed inside the tube 44 of the ink delivery tube 43. As shown in FIG. 7(A), the second valve 60 includes: a valve seat 61; the valve member 62 (moving body); and a coil spring 63. The valve seat 61 is configured of an elastic member such as rubber or the like. A flange 61*a* formed on the valve seat 61 is interposed between: a stepped part 45*a* formed in the tube 45; and an annular protrusion 44*a* which protrudes from the inner surface of the tube 44 at a region near the center of the tube 44. A through-hole 61*b* is formed in the center of the valve seat 61 and penetrates the valve seat 61 in the main scanning direction to allow communication between the tube 44 and tube 45.

The valve member 62 includes a valve body 62*a*, a connecting portion 62*b*, a detected portion 62*c*, and a spring attachment portion 62*d*. The valve body 62*a* has a disk-like shape and is slid along an inner peripheral surface of the tube 44 to abut against the valve seat 61 to close the second valve 60 or to be separated from the valve seat 61 to open the second valve 60. The detected portion 62*c* has substantially a columnar shape extending in the main scanning direction and can be slid along the inner peripheral surface of the tube 44. The detected portion 62*c* is configured of a magnetic body, specifically, a magnet and is detected by the magnetic sensor 66. The spring attachment portion 62*d* has a columnar shape having a diameter smaller than a diameter of the detected portion 62*c* and is fitted with one end of the coil spring 63. The connecting portion 62*b* is a columnar rod-like member extending in the main scanning direction and connects the valve body 62*a* and detected portion 62*c*. A diameter of the connecting portion 62*b* is smaller than diameters of the valve body 62*a* and detected portion 62*e*. The valve body 62*a*, connecting portion 62*b*, and spring attachment portion 62*d* are each configured of a non-magnetic body (e.g., resin), and the valve body 62*a* and connecting portion 62*b* are integrally formed with each other. The detected portion 62*c* is bonded to the connecting portion 62*b* and spring attachment portion 62*d* by adhesive.

Figure 7C:
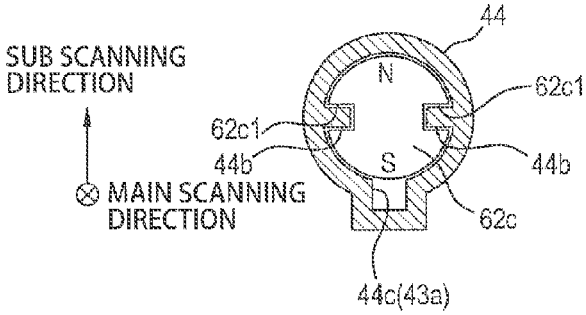
FIG. 7(C) is a cross-sectional view taken along a line VII(c)-VII(c) in FIG. 7(A)
Figure 8:
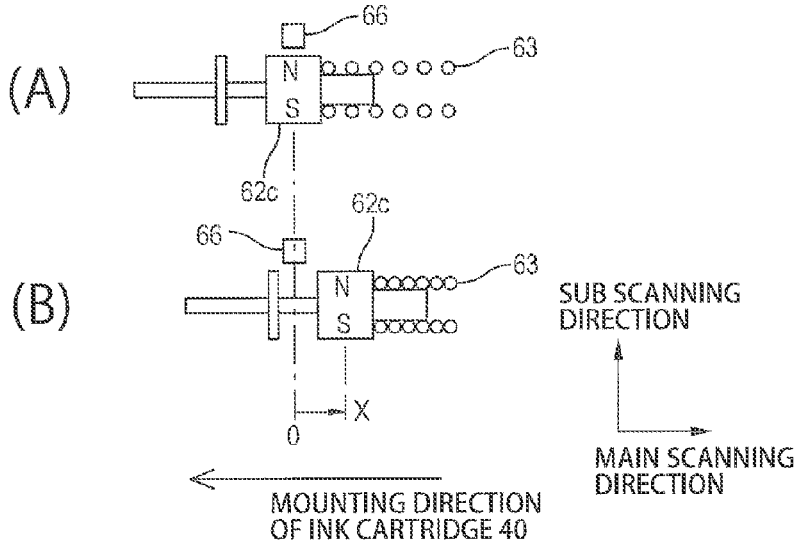
FIG. 8 illustrates how a detected portion of the second valve moves relative to a case of the ink cartridge, wherein (A) shows the initial state of the detected portion when the second valve is in the closed state, and (B) shows the state of the detected portion when the detected portion has moved from the initial state along the main scanning direction relative to the case of the ink cartridge.

As illustrated in FIG. 7(C), the detected portion 62*c* is magnetized in the sub-scanning direction. That is, N- and S-poles of the detected portion 62*c* are arranged in the sub-scanning direction. The detected portion 62*c* is splined to the tube 44 so that attitude of the detected portion 62*c* is maintained such that the N- and S-poles are arranged in the sub-scanning direction. Specifically, a pair of grooves 62*c*1 (attitude maintaining structure) are formed in a peripheral surface of the detected portion 62*c*. The grooves 62*c*1 extend in the main scanning direction. Moreover, a pair of protrusions 44*b* (attitude maintaining structure) are formed in an inner peripheral surface of the tube 44. The protrusions 44*b* also extend in the main scanning direction. The protrusions 44*b* are engaged with the corresponding grooves 62*c*1. With the above configuration, the detected portion 2*c* is allowed to move relative to the tube 44 along the main scanning direction but not allowed to rotate relative to the tube 44 about the main scanning direction. That is, the substantially columnar-shaped detected portion 62*c* cannot rotate about its axis. Thus, a magnetic flux extending in the sub-scanning direction is always generated from the detected portion 62*c*. A density of the magnetic flux that is generated from the detected portion 62*c* and that extends in the sub-scanning direction is maximum at substantially a center position of the detected portion 62*c* in the main scanning direction.

As described already, one end of the coil spring 63 is fixed to the spring attachment portion 62*d*, while the other end contacts the connector 42*a* (FIG. 7(A)). With this configuration, the coil spring 63 constantly urges the valve member 62 toward the valve seat 61. In other words, the coil spring 63 urges the valve member 62 in a direction toward the sealing member 51. By contacting the right end of the valve seat 61 in the figure (peripheral edge of the through-hole 611), the valve body 62*a* interrupts communication in the ink channel 43*a*, i.e., interrupts communication between the tube 44 and tube 45 and placing the second valve 60 in a closed state. At this time, the right end of the valve seat 61 in the figure is elastically deformed by the urging force of the coil spring 63. Further, since the coil spring 63 urges the valve member 62 in a direction toward the sealing member 51 and the elements constituting the first and second valves 50 and 60 are aligned in the main scanning direction, the first and second valves 50 and 60 can be opened and closed by the insertion and removal of the hollow needle 153 with respect to the sealing member 51. Further, the second valve 60 can be configured through a simple construction that reduces the chance of malfunctions. Here, an urging member other than a coil spring may be used in place of the coil spring 63.

A pressing member 70 is also disposed inside the ink delivery tube 43. The pressing member 70 is for moving the valve member 62 by pushing the valve member 62 in a direction opposite to the direction, in which the valve member 62 is urged by the coil spring 63, when the hollow needle 153 is inserted into the ink delivery tube 43. The pressing member 70 is rod-shaped and extends in the main scanning direction. The pressing member 70 is formed from non-magnetic body (resin, for example) and is integrally formed with the valve body 62*a*. The pressing member 70 has a smaller diameter than the through-hole 61*b* and is disposed to pass through the through-hole 61*b*. As shown in FIG. 7(A), the pressing member 70 has such a length that forms a gap between the distal end of the pressing member 70 and the sealing member 51 while the valve body 62*a* is in contact with the valve seat 61 (the second valve 60 is in the closed state).

When the ink cartridge 40 is moved in the mounting direction (leftward in FIG. 7(A)) along the main scanning direction so as to be mounted into the printer 1, the hollow needle 153 contacts the distal end of the pressing member 70, as shown in FIG. 7(B), after the hollow needle 153 penetrates the sealing member 51 to switch the first valve 50 to the open state. As the hollow needle 153 is inserted further, the pressing member 70 and valve member 62 move relative to the case 41 in a direction, in which the coil spring 63 shrinks, that is, rightward in the figure along the main scanning direction, and the valve body 62*a* separates from the valve seat 61, causing the second valve 60 to change from the closed state to the open state. Since communication is now established between parts of the ink channel 43*a* in the tubes 44 and 45, ink in the ink bag 42 flows into the hollow needle 153. Conversely, when the hollow needle 153 is pulled out of the first valve 50, the urging force of the coil spring 63 moves the valve member 62 and the pressing member 70 until the valve body 62*a* is pressed tightly against the valve seat 61, thereby changing the second valve 60 from the open state to the closed state. Accordingly, the second valve 60 also enters either the open state for providing communication throughout the ink channel 43*a* of the ink delivery tube 43 or the closed state for interrupting communication in the ink channel 43*a* based on insertion and retraction of the hollow needle 153.

As illustrated in FIG. 7(A), the magnetic sensor 66 is disposed in the case 41 (chamber 41*b*) at a position separate away from the tube 44 in the sub-scanning direction and opposite to a prescribed position of the tube 44 defined in the main scanning direction. The prescribed position is a location at which the center of the detected portion 62*c* in the main scanning direction is positioned in an initial state (FIG. 7(A)) when the second valve 60 is closed. The magnetic sensor 66 is, e.g., a Hall element and is fixed in such a direction so as to sense the magnetic flux passing through the magnetic sensor 66 in the sub-scanning direction. The magnetic sensor 66 outputs, to the controller 90, a signal indicating a magnetic flux density of the sensed magnetic flux.

Here, the position of the detected portion 62*c* in the tube 44 in the main scanning direction, that is, the position of the detected portion 62*c* relative, to the case 41 in the main scanning direction is defined as follows. FIGS. 8(A) and 8(B) are views for explaining states where when the ink cartridge 40 is moved in a mounting direction (left direction in the drawings) so as to be mounted to the mounting unit 150, the detected portion 62*c* moves in the tube 44 relative to the case 41 in a direction (right direction in the drawings) opposite to the mounting direction.

That is, it is assumed that at the initial state where the second valve 60 is closed, the center of the detected portion 62*c* in the main scanning direction is located at an origin position X=0 defined in the case 41 with respect to the main scanning direction. Moreover, an X-axis is defined as an axis extending from the origin position X=0 along a moving path of the detected portion 62*c* in a direction opposite to the mounting direction. The X-axis is parallel to the main scanning direction. Moreover, a position defined in the case 41 (relative position to the case 41) of the center of the detected portion 62*c* in the main scanning direction is defined as "position X of the detected portion 62*c*". When the ink cartridge 40 is moved in the mounting direction, the hollow needle 153 pushes the valve member 62. Accordingly, as illustrated in FIG. 8(B), the detected portion 62*c* moves relative to the case 41 in a direction opposite to the mounting direction along the main scanning direction. Specifically, the detected section 62*c* moves from the origin position X=0 in the case 41 in a direction opposite to the mounting direction along the main scanning direction and sequentially passes through a first prescribed position X=X1 and a second prescribed position X=X2 in this order, followed by completion of the mounting of the ink cartridge 40. The first and second prescribed positions X=X1 and X=X2 are defined in the case 41. Each of the values X1 and X2 is a moving distance from the origin position X=0 in the main scanning direction. The moving distance X2 is larger than the moving distance X1.

Figure 9A:
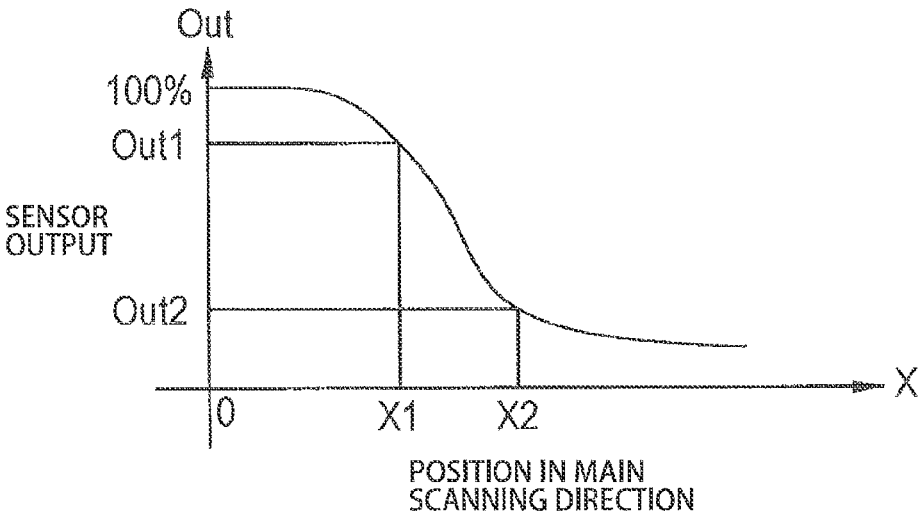

The magnetic sensor 66 is fixed to a position in the case 41 facing the origin position X=0 (position separated from the origin position X=0 in the sub-scanning direction). Thus, a prescribed relationship illustrated in FIG. 9(A) is established between an output Out of the magnetic sensor 66 (amount of a sub-scanning direction component of the magnetic flux) and position X of the detected portion 62*c*. That is, the output Out of the magnetic sensor 66 becomes a maximum value (100%) in an initial state where the detected portion 62*c* is located at the origin position X=0. This is because, in the initial state, the magnetic sensor 66 faces a position of the detected portion 62*c* at which the magnetic flux density is the maximum. As the detected portion 62*c* moves from the origin position X=0 along the main scanning direction, the sensor output Out is gradually reduced as shown in the graph of FIG. 9(A). Specifically, when the detected portion 62*c* reaches the first prescribed position. X=X, the output Out of the magnetic sensor 66 reaches a first prescribed value Out1 lower than 100%. When the detected portion 62*c* reaches the second prescribed position X==X2, the output Out of the magnetic sensor 66 reaches a second prescribed value Out2 lower than the first prescribed value Out1. After further movement of the detected portion 62*c*, the mounting of the ink cartridge 40 to the printer 1 is completed.

Figure 9B:
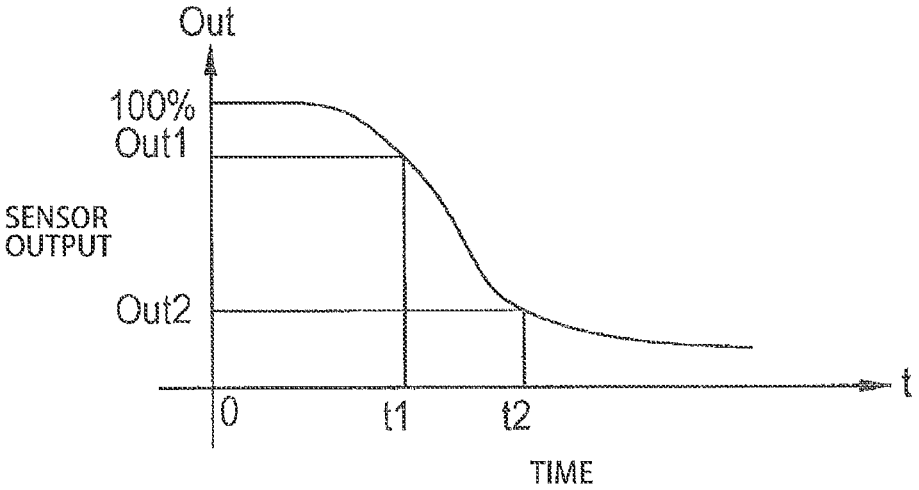

As illustrated in FIG. 9(B), a time length (t2−t1) between a time t1 at which the sensor output Out reaches the first prescribed value Out1 and a time t2 at which the sensor output Out reaches the second prescribed value Out2 indicates a time length (hereinafter, referred to a moving time) during which, the detected portion 62*c* moves from the first prescribed position X1 to the second prescribed position X2 by a distance (X2-X1). The distance (X2-X1) is constant. Thus, the moving time indicates a moving speed of the detected portion 62*c* with respect to the magnetic sensor 66. That is, the shorter the moving time, the higher the moving speed.

Actually, in mounting the ink cartridge 40 to the printer 1, the detected portion 62*c* stays at the origin position X=until the hollow tube 153 abuts against the distal end of the pressing member 70. When the ink cartridge 40 is moved in the mounting direction by a distance X1 after the hollow tube 153 abuts against the distal end of the pressing member 70, the detected portion 62*c* reaches the first prescribed position X=X1. When the ink cartridge 40 is further moved in the mounting direction by a distance (X2-X1), the detected portion 62*c* reaches the second prescribed position X=X2. Thus, the moving time (t2−t1) indicates a moving speed of the ink cartridge 40 during a time during which the hollow tube 153 moves the second valve member 62 to open the second valve 60.

The storage unit 125 stores the first and second prescribed values Out1 and Out2. The storage unit 125 further stores data shown in Table 1 below. Table 1 indicates the necessity for a maintenance operation (ink forcibly ejecting operation to forcibly eject ink from a recording head) on an inkjet head 2 and the amount of ink leakage from ejection holes in the inkjet head 2 (the amount of ink flowing out of the ink accommodating unit) when an ink cartridge 40 is mounted in the mounting unit 150 described later. More specifically, Table 1 indicates the necessity for a maintenance operation and the quantity of ink leakage for each of combinations of: four time ranges T1-T4; and four ink volume ranges V1-V4. In this example, time range T1 is set to a range from 0 seconds to less than 0.2 seconds, time range T2 to a range greater than or equal to 0.2 seconds and less than 0.4 seconds, time range T3 to a range greater than or equal to 0.4 seconds and less than 0.6 seconds, and time range T4 to a range greater than or equal to 0.6 seconds. Thus, the time ranges T1-T4 are arranged adjacent to one another. Further, ink volume range V1 is set to a range from 0 mil to less than 500 ml, ink volume range V2 to a range greater than or equal to 500 ml and less than 700 ml, ink volume range V3 to a range greater than or equal to 700 ml and less than 800 ml, and ink volume range V4 to a range greater than or equal to 800 ml and less than 1,000 ml. Thus, the ink volume ranges V1-V4 are arranged adjacent to one another.

TABLE 1

| | | Ink volume range | | | |
|---|---|---|---|---|---|
| | | V1 | V2 | V3 | V4 |
| Time range | T1 | Maintenance not required No ink leakage occurs | Maintenance required ink leakage occurs (ink of almost 0 ml) | Maintenance required ink leakage occurs (very slight amount of ink) | Maintenance required ink leakage occurs (some ink) |

TABLE 1-continued

| | Ink volume range | | | |
|---|---|---|---|---|
| | V1 | V2 | V3 | V4 |
| T2 | Maintenance not required No ink leakage occurs | Maintenance not required No ink leakage occurs | Maintenance required ink leakage occurs (ink at almost 0 ml) | Maintenance required ink leakage occurs (very slight amount of ink) |
| T3 | Maintenance not required No ink leakage occurs | Maintenance not required No ink leakage occurs | Maintenance not required No ink leakage occurs | Maintenance required ink leakage occurs (ink of almost 0 ml) |
| T4 | Maintenance not required No ink leakage occurs | | | |

Hence, for the case where the mounted ink cartridge 40 has an ink volume falling within ink volume range V1, the Table 1 indicates that no ink leakage occurs and that maintenance is not necessary, regardless of which time range T1-T3 the moving time (t2-t1) falls in.

For the case where the mounted ink cartridge 40 has an ink volume that falls within ink volume range V2, the Table 1 indicates that ink leakage with an amount of almost zero (0) ml occurs and maintenance is necessary only when the moving time falls within time range T1. In other words, the Table 1 indicates that an extremely tiny amount of ink may possibly leak and maintenance is necessary when the moving time is less than 0.2 seconds (prescribed time). Thus, 0.2 seconds is the threshold for indicating whether or not maintenance will be required.

For the case where the mounted ink cartridge 40 has an ink volume that falls within ink volume range V3 and the moving time falls within time range T1, the Table 1 indicates that a very slight amount of ink leaks (approximately 1 ml, for example) and that maintenance is necessary. For the case where the mounted ink cartridge 40 has an ink volume that falls within ink volume range V3 and the moving time falls within time range T2, the Table 1 indicates that ink of almost zero (0) ml leaks and that maintenance is necessary. In other words, when the ink volume of the mounted ink cartridge 40 falls within ink volume range V3, maintenance is required if the moving time is less than 0.4 seconds (prescribed time), but unnecessary if the moving time is longer than or equal to 0.4 seconds.

For the case where the mounted ink cartridge 40 has an ink volume that falls within ink volume range V4, the Table 1 indicates that maintenance is necessary, regardless of which time range T1-T3 the moving time falls in. The Table 1 also indicates that a small amount of ink (some ink) leaks (about 3 ml, for example) when the moving time falls within time range T1, that a very slight amount of ink leaks when the moving time falls within time range T2, and that ink of almost zero (0) ml leaks when the moving time falls within time range T3. It is noted that the Table 1 further indicates that ink does not leak and maintenance is unnecessary when the moving time is greater than or equal to 0.6 seconds (prescribed time), that is, when the moving time falls in a time range T4, if the volume of ink in the ink cartridge 40 is less than 1,000 ml.

In this way, the storage unit 125 stores data specifying prescribed threshold times (0, 0.2, 0.4, and 0.6 seconds) corresponding to the respective ink volume ranges V1-V4 for which maintenance becomes necessary. In other words, the storage unit 125 stores the prescribed time 0 seconds for ink volume range V1, the prescribed time of 0.2 seconds for ink volume range V2, the prescribed time of 0.4 seconds for ink volume range V3, and the prescribed time of 0.6 seconds for ink volume range V4. These prescribed times are increased as the quantities of ink specified by ink volume ranges V1-V4 are increased.

A manufacturer of the ink cartridge 40 creates the Table 1 by performing an experiment. During the experiment, the manufacturer prepares a plurality of ink cartridges 40 that are filled with ink of various volumes. The manufacturer mounts the ink cartridges 40 in the mounting unit 150 of the inkjet printer 1 at various speeds. The manufacturer measures the amount of ink leakage.

The storage unit 125 is configured of flash memory that can be overwritten by the controller 90 or an external device such as the printer body, and further stores data specifying quantity of ink stored in the ink cartridge 40 that is provided with the storage unit 125. Hence, when ink is consumed during the printing operation or purge operation, the controller 100 can subtract the quantity of ink consumed in the operation from the ink quantity in the ink cartridge 40 prior to the operation and update the data stored in the storage unit 125 with the resulting quantity of residual ink. Further, since the storage unit 125 stores the quantity of leaked ink, the quantity of remaining ink can be corrected when overwriting the ink quantity in the storage unit 125. That is, the controller 90 can update the quantity of remaining ink by subtracting the amount of ink that is leaked when the ink cartridge 40 is mounted. Accordingly, the storage unit 125 can accurately store the current amount of residual ink.

Further, when an ink cartridge 40 that has run out of ink is refilled in order to be reused in the inkjet printer 1, the data indicating the quantity of ink in the ink cartridge 40 can easily be overwritten, even when the specifications of the ink cartridge 40 itself have changed, such as when the quantity of ink dispensed or refilled at the factory or the like is greater than or less than the original prescribed quantity. Moreover, since the storage unit 125 is provided in the ink cartridge 40, the storage capacity of memory in the printer body itself can be reduced.

Next, mounting units 150 formed in the body of the inkjet printer 1 will be described with reference to FIG. 10 and FIG. 11. Four of the mounting units 150 juxtaposed in the sub scanning direction are provided in the printer body for receiving the respective ink cartridges 40 when mounting the ink cartridges 40 in the printer body. Since the mounting units 150 have substantially the same structure, only one of the mounting units 150 will be described below.

Figure 11A:
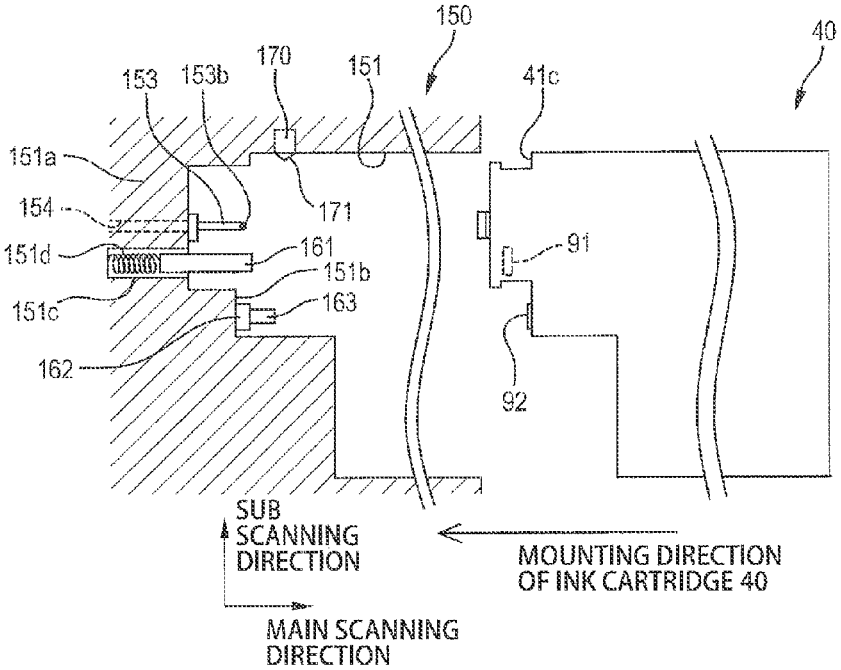
Figure 11B:
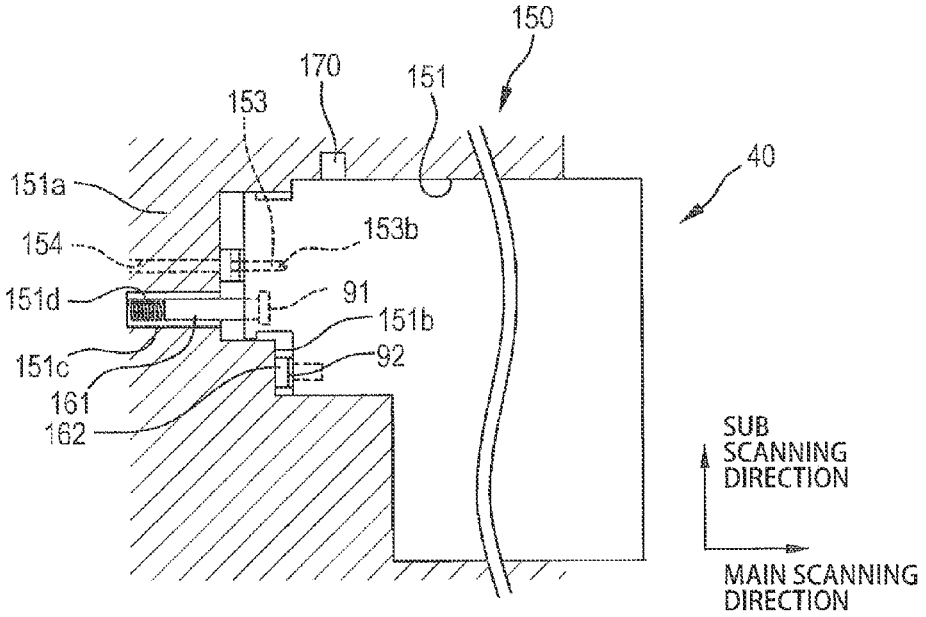

As shown in FIG. 11(A) and FIG. 11(B), the mounting unit 150 has a recessed part 151 that conforms to the outer shape of the ink cartridge 40. The recessed part 151 has the most inward part 151*a* in the main scanning direction. On the most inward part 151*a*, there are provided the hollow needle 153, the ink supply channel 154, a contact point 161 electrically connected to the controller 100, and the power output part 162 for outputting electricity produced by a power supply unit 110 (see FIG. 10) provided in the printer body.

The hollow needle 153 is fixedly disposed at such a position that the hollow needle 153 will oppose the ink outlet 46*a* and is longitudinally oriented in the main scanning direction. The hollow needle 153 has an inner hollow region 153*a* in fluid communication with the ink supply channel 154, and a hole 153*b* formed near the distal end thereof for providing external communication with the hollow region 153*a* (see also FIG. 7(B)). With this construction, the hollow needle 153 is in a state of communication with the tube 45 side of the ink channel 43*a* when the ink cartridge 40 is mounted in the printer body and the hole 153*b* has passed through the sealing member 51. However, communication between the hollow needle 153 and the ink channel 43*a* is interrupted when the hole 153*b* enters the sealing member 51 as the ink cartridge 40 is being removed from the printer body. Note that although communication between the hollow needle 153 and ink channel 43*a* is established when the hole 153*b* has passed through the sealing member 51, ink does not flow from the ink bag 42 into the hollow region 153*a* until the second valve 60 has changed to an open state. Further, the paths from the hole 153*b* of the hollow needle 153 to the ejection holes in the inkjet head 2 are hermetically sealed channels that are not exposed to the outside air. Accordingly, it is possible to suppress an increase in ink viscosity since the ink in these channels is not exposed to air.

As shown in FIG. 11(A), the contact point 161 is juxtaposed with the hollow needle 153 in the sub scanning direction and disposed at such a position that the contact point 161 will oppose the contact point 91. The contact point 161 is configured of a rod-shaped member that extends in the main scanning direction and is slidably supported in a hole 151*c* that is formed in the most inward part 151*a* and that is elongated in the main scanning direction. A spring 151*d* is provided in the hole 151*c* and urges the contact point 161 outward from the hole 151*c* so that the contact point 161 makes an electrical connection with the contact point 91 just prior to the hollow needle 153 being inserted into the sealing member 51 when the ink cartridge 40 is mounted in the printer body. In other words, the contact point 161 is electrically connected to the contact point 91 before the first valve 50 changes to an open state. Conversely, when the ink cartridge 40 is removed from the printer body, the contact point 161 remains electrically connected to the contact point 91 until the hollow needle 153 is extracted from the sealing member 51 (FIG. 11(B)).

As shown in FIG. 11(A), the power output part 162 is provided in a stepped surface 151*b* formed on the most inward part 151*a*. The power output part 162 is disposed at such a position that the power output part 162 will oppose the power input unit 92. The power output part 162 also has a contact point 163 that protrudes outward in the main scanning direction. When the ink cartridge 40 is mounted in the printer body, the contact point 163 is inserted into the power input unit 92 and forms an electrical connection with the same (see FIG. 11(B)). As with the contact point 161, the contact point 163 becomes electrically connected to the power input unit 92 just before the hollow needle 153 is inserted into the sealing member 51.

A sensor 170 (mounting detecting unit) is also provided in the recessed part 151 of each mounting unit 150. The sensor 170 is connected to the controller 100 and serves to detect the case 41 of the ink cartridge 40. Specifically, the sensor 170 is a mechanical switch-type sensor that detects the presence of an object through contact. The sensor 170 includes a detecting part 171 that is urged out of the sensor 170 into the recessed part 151 (FIG. 11(A)). When the stepped surface 41*c* of the case 41 of the ink cartridge 40 contacts the detecting part 171 and pushes the detecting part 171 into the sensor 170 (FIG. 11(B)), the sensor 170 outputs a signal indicating the retracted state of the detecting part 171 (hereinafter referred to as signal A) to the controller 100. When the ink cartridge 40 is removed from the mounting unit 150, eliminating contact between the case 41 and detecting part 171 and enabling the detecting part 171 to emerge again from the sensor 170 (FIG. 11(A)) the sensor 170 outputs a signal indicating this protruding state of the detecting part 171 (hereinafter referred to as signal B) to the controller 100. Upon receiving these signals, the controller 100 can determine whether the ink cartridge 40 is mounted in the mounting unit 150. In the embodiment, the controller 100 determines that the ink cartridge 40 is either mounted in the mounting unit 150 or positioned near the mounting position within the mounting unit 150 upon receiving signal A indicating that the detecting part 171 is retracted in the sensor 170, and determines that the ink cartridge 40 is not mounted in the mounting unit 150 upon receiving signal B indicating that the detecting part 171 is protruding from the sensor 170. The sensor 170 may also be configured of a photosensor and the like and is not limited to a mechanical switch-type sensor.

As shown in FIG. 2(A), the inkjet printer 1 also includes a buzzer 13 (notifying unit) disposed in the casing 1*a*. The controller 100 controls the buzzer 13 to emit various sounds. The sounds are designed to alert the user when, for example, no data is stored in the storage unit 125, the ink cartridge 40 is not mounted correctly, and it is OK to print. The sounds are designed also to ask the user as to whether a maintenance operation should be performed.

Figure 12:
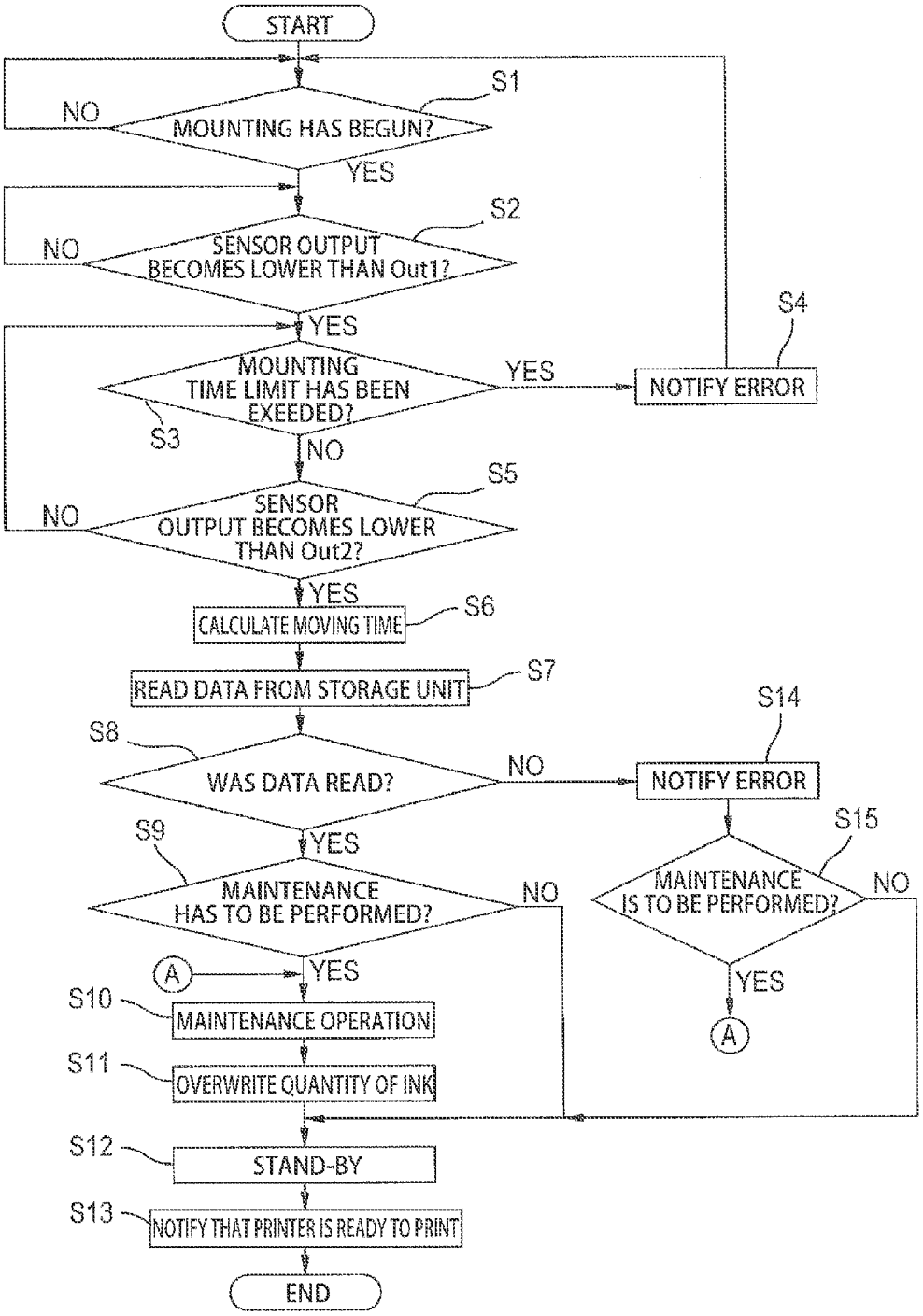
FIG. 12 is a flowchart illustrating steps in a control process according to the first embodiment when the ink cartridge is mounted in the mounting unit of the printer.

As shown in FIG. 10, a storage unit 120 is provided in the casing 1*a*. The storage unit 120 is electrically connected to the controller 100 and power supply unit 110. An execution program to be executed by the controller 100 is stored in the storage unit 120, while an execution program to be executed by the controller 90 is stored in the storage unit 125. Programs to be described later with reference to FIG. 12 are executed by the printer main body 1 and the ink cartridge 40 mutually communicating with each other. The execution programs to be executed by the controllers 100 and 90 may be stored as a whole in the storage unit 125, and be executed by the controllers 100 and 90. Or, the execution programs to be executed by the controllers 100 and 90 may be stored as a whole in the storage unit 120, and be executed by the controllers 100 and 90. A prescribed mounting time limit to be described later is also stored in the storage unit 120. Additionally, a manipulation unit (not shown) is provided in the casing 1*a*, enabling the user to input his/her instruction, such as an instruction to or not to perform a maintenance operation.

Next, operations performed when an ink cartridge 40 is being mounted into the printer body will be described with reference to the flowchart in FIG. 12. In order to mount one of the four ink cartridges 40 in the respective mounting unit 150, as shown in FIG. 12, the operator mounts the ink cartridge 40 in the corresponding mounting unit 150 after opening the door 1*c* on the printer body. At this time, the controller 100 determines in S1 whether mounting of the ink cartridge 40 in the mounting unit 150 has begun. The controller 100 makes this determination when the case 41 of the ink cartridge 40 contacts the detecting part 171 of the sensor 170, causing the signal outputted from the sensor 170 to change from signal B to signal A and the controller 100 to receive this signal A. While continuing to receive the signal B from the sensor 170, the controller 100 determines that mounting has not begun and continues to wait. When the signal A is received from the sensor 170, the controller 100 determines that mounting has begun and advances to S2.

In S2, the controller 90 compares the output of the magnetic sensor 66 with the prescribed value Out1. If the output of the magnetic sensor 66 is higher than or equal to the prescribed value Out1 (No in S2), the controller 90 repeatedly compares the magnetic sensor output with the prescribed value Out1 until the magnetic sensor output becomes lower than the prescribed value Out1. When the magnetic sensor output becomes lower than the prescribed value Out1 (Yes in S2), the process proceeds to S3.

In S3 the controller 100 determines whether a mounting time limit has elapsed since the signal A was received and before the magnetic sensor output has reached the prescribed value Out2. Specifically, the controller 100 determines whether the amount of elapsed time after the signal A was received has exceeded the mounting time limit stored in the storage unit 120 (see FIG. 10). If the elapsed time exceeds the mounting time limit (S3: YES), in S4 the controller 100 controls the buzzer 13 to emit a sound for notifying the user that the ink cartridge 40 is not properly mounted in the mounting unit 150. The process returns from S4 back to S1. Some reasons in which the ink cartridge 40 was not properly mounted in the mounting unit 150 might include damage to the tip of the hollow needle 153 that prevents the hollow needle 153 from moving the valve member 62 or a break in the pressing member 70 that prevents the pressing member 70 from moving the valve member 62. On the other hand, if the elapsed time does not exceed the mounting time limit (S3: NO), the controller 100 advances to S5.

In S5, the controller 90 compares the output of the magnetic sensor 66 with the prescribed value Out2. If the output of the magnetic sensor 66 is higher than or equal to the prescribed value Out2 (No in S5), the process returns to S3. When the magnetic sensor output becomes lower than the prescribed value Out2 (Yes in S5), in S6 the controller 90 calculates, as a moving time, a time difference (t2-t1) between a timing t1 when the output of the magnetic sensor 66 becomes lower than the prescribed value Out1 and a timing t2 when the output of the magnetic sensor 66 becomes lower than the prescribed value Out2.

The operations that occur after the sensor 170 outputs the signal A and until the sensor output reaches the prescribed value out2 are as follows. First, in the period after the sensor 170 outputs the signal A to the controller 100 and until the hollow needle 153 is inserted into the sealing member 51, the contact point 91 and contact point 161 become electrically connected and the contact point 163 of the power output part 162 and the power input unit 92 become electrically connected. These connections enable the two controllers 90 and 100 to be electrically connected to each other and to exchange signals and allow power to be supplied to the controller 90 and magnetic sensor 66. Next, after the hollow needle 153 penetrates the sealing member 51, the tip of the hollow needle 153 contacts the pressing member 70, moving the pressing member 70 and valve member 62 rightward in FIG. 7(B). As the valve member 62 separates from the valve seat 61, the second valve 60 changes from the closed state to the open state.

Next, in S7 the controller 90 reads the current ink quantity and the data indicated in Table 1 stored in the storage unit 125. In S8 the controller 90 determines whether data was read from the storage unit 125 in S7. If the controller 90 was unable to read the above data because the data is not stored in the storage unit 125 (S8: NO), then the controller 90 outputs an error signal to the controller 100. In S14, upon receiving the error signal, the controller 100 controls the buzzer 13 to emit a sound alerting the user of a problem with the storage unit 125. The process then proceeds to S15, in which the controller 100 controls the buzzer 13 to emit a sound asking the user whether to or not to perform a maintenance operation. If the user inputs, to the manipulation unit (not shown), his/her instruction to perform a maintenance operation (yes in S15), the process proceeds to S10 to be described later. If the user inputs his/her instruction not to perform a maintenance operation (no in S15), the process proceeds to S12 to be described later. However, if the controller 90 determines that data was successfully read from the storage unit 125 (S8: YES), the controller 90 advances to S9.

In S9 the controller 90 determines within which of the time ranges T1, T2, T3, and T4 the moving time calculated in S6 falls, determines within which of the ink volume ranges V1, V2, V3, and V4 the volume of ink in the mounted ink cartridge 40 falls, and determines whether maintenance has to be performed for the newly mounted ink cartridge 40. In other words, the controller 90 compares the moving time for the current ink cartridge 40 with the prescribed time indicating the threshold for determining whether maintenance is required with respect to the ink volume range (V1, V2, V3, or V4), within which the ink volume in the currently mounted ink cartridge 40 falls, and determines whether the moving time is shorter than the prescribed time.

If the controller 90 determines that maintenance is not required at this time (S9: NO), the controller 90 determines that no ink leaked from the inkjet head 2 and, therefore, advances to S12 and enters a standby state, i.e., a print-ready state.

However, if the controller 90 determines that maintenance is required (S9: YES), in S10 the controller 90 outputs a signal to the controller 100 requesting that maintenance be started. Upon receiving this signal, the controller 100 first controls the elevating mechanism to move the inkjet heads 2 from the printing position (see FIG. 2(A)) to the retracted position (see FIG. 4(A)) in order to perform a purge operation to purge ink from the inkjet head 2. Next, the controller 100 controls a drive motor to move the caps 31 to positions opposing the ejection surfaces 2*a* (see FIG. 4(B)). Next, the controller 100 controls a drive motor to move the caps 31 toward the respective ejection surfaces 2*a* and into a capping position (see FIG. 4(C)).

Subsequently, the controller 100 drives the pump 104 for a prescribed time in order to forcibly supply ink from the ink cartridge 40 to the inkjet head 2, thereby purging a prescribed quantity of ink from the inkjet head 2 into the cap 31. Next, the controller 100 controls drive motors for returning the caps 31 front the capping position to their initial position. At this time, the controller 100 may also control a wiper mechanism in the maintenance unit 30 that includes a wiper and a drive motor for operating the wiper (not shown), for example, to wipe off ink deposited on the ejection surface 2*a*. Next, the controller 100 controls the elevating mechanism to return the inkjet heads 2 from the retracted position to the printing position. Once the inkjet heads 2 are returned to the printing position, the maintenance operation is complete. After performing this maintenance operation, the controller 100 outputs a signal to the controller 90 indicating that maintenance is complete.

Upon receiving notification that maintenance was completed, in S11 the controller 90 overwrites the quantity of ink stored in the storage unit 125. More specifically, the controller 90 first determines whether the amount of leaked ink is "ink of almost zero (0) ml," a "very slight amount of ink," or "some ink," by referring to the Table 1. That is, by referring to Table 1, the controller 90 determines which of "ink of almost zero (0) ml," a "very slight amount of ink," or "some ink" is the quantity of leaked ink that corresponds to a combination of: an ink volume range (either one of V1-V4), in which the ink quantity stored in the storage unit 125 falls; and a time range (either one of T1-T4), in which the moving time (t2-t1) calculated in S6 falls. Next, the controller 90 subtracts this determined quantity of leaked ink and the quantity of ink expended in the purging operation from the quantity of ink stored in the storage unit 125, and updates the ink quantity in the storage unit 125 with the result. This is because it is known that ink of the same amount with the ink leaked from the inkjet head 2 flows out of the ink cartridge 40 when the ink cartridge 40 is mounted in the mounting unit 150. The quantity of ink expended during a purge operation may be set to a fixed amount, or may be suitably adjusted with consideration for environmental factors such as temperature. In the latter case, the controller 100 must notify the controller 90 of the amount of ink expended during the purge operation. Next, the controller 100 enters the standby state, i.e., the print-ready state, in S12.

In S13 the controller 90 outputs a signal to the controller 100 indicating that the ink cartridge 40 is print-ready. After receiving this signal, the controller 100 controls the buzzer 13 to emit a sound for notifying the user that the printer 1 is ready to print, and the operation for mounting the ink cartridge 40 is complete. The operation for updating the ink quantity of the ink cartridge 40 described in S11 may instead be performed after the operation in S13 and before the controller 100 begins a printing operation.

It is noted that during the printing process, the controller 100 does not drive the pump 104. When ink is ejected from the ejection surface 2*a* of the inkjet head 2 to perform printing operation, ink of the same amount with the ejected ink is drawn into the inkjet head 2 from the ink cartridge 40 due to a capillary force.

With the inkjet printer 1 according to the embodiment, the controller 100 or the controller 90 updates the quantity of residual ink in the ink cartridges 40 not only in S11 of the mounting operation, but also after printing operations by subtracting the quantity of ink consumed during the printing operation or the like from the quantity of ink stored in the storage unit 125 before the printing operation was performed. It is noted that the quantity of ink consumed during the printing operation is determined based on print data based on which the printing operation, is executed. Thus, if an ink cartridge 40 containing at least some residual ink is temporarily removed from the mounting unit 150 and subsequently remounted in the mounting unit 150, the controller 100 can limit the maintenance operations performed on the inkjet heads 2 to only those cases in which the moving time is less than a prescribed time associated with the quantity of residual ink in the mounted ink cartridge 40, thereby reducing the number of unnecessary maintenance operations.

Next, the operations performed when an ink cartridge 40 is removed from the printer body will be described. When an ink cartridge 40 has run out of ink, for example, the operator opens the door 1*c* and removes the ink cartridge 40 from the printer body. As the ink cartridge 40 moves out of the printer body, the valve member 62 and pressing member 70 move leftward in FIG. 7(B) by the urging force of the coil spring 63. That is, the pressing member 70 and valve member 62 operate in reverse to that described when the hollow needle 153 is inserted. Thus, the valve member 62 contacts the valve seat 61, shifting the second valve 60 from the open state to the closed state and halting the flow of ink from the ink cartridge 40 into the hollow needle 153. At this time, the signal outputted from the magnetic sensor 66 to the controller 90 returns to 100%, at which time the controller 90 detects that the second valve 60 is in the closed state.

Subsequently, the first valve 50 changes from the open state to the closed state when the hole 153*b* of the hollow needle 153 enters the inside of the sealing member 51. In this way, the first valve 50 and second valve 60 are automatically switched from their open states to their closed states as the hollow needle 153 is withdrawn, with the first valve 50 changing to the closed state after the second valve 60 changes to the closed state.

As the ink cartridge 40 continues to be removed, the hollow needle 153 is extracted from the sealing member 51, and thereafter the contact point 91 and contact point 161 are disconnected and the power input unit 92 and contact point 163 are disconnected. When the case 41 separates from the detecting part 171 so that the detecting part 171 protrudes out from the sensor 170, the sensor 170 outputs the signal B to the controller 100, by which signal the controller 100 can determine that the ink cartridge 40 has been removed from the printer body. Thereafter, the operator replaces the ink cartridge 40 that was removed from the printer body with a new ink cartridge 40, mounting the new ink cartridge 40 in the printer body according to the procedure described above.

Next, steps performed when manufacturing and recycling an ink cartridge will be described. To manufacture a new ink cartridge in the embodiment, first the case 41 is manufactured in halves. Components of the ink cartridge 40, such as the ink bag 42 and ink delivery tube 43 are then assembled in one half of the case 41, as shown in FIG. 6. Next, the other half of the case 41 is joined with the first half, thereby completing the basic structure of an empty cartridge not yet filled with ink. Next, a dispenser is used to dispense a prescribed quantity of ink into the ink, bag 42 of the cartridge. Then, data indicating the values shown in Table 1 and data indicating the quantity of dispensed ink are copied from a storage device into the storage unit 125 of the ink cartridge 40, thereby completing the ink cartridge manufacturing process.

As a variation of this process, when assembling the components of the ink cartridge 40 in one half of the case 41, the ink bag 42 may be pre-filled with ink before being installed in the case 41. Subsequently, the other half of the case 41 is joined with the first half, and the prescribed data is copied from a storage device into the storage unit 125.

On the other hand, when restoring a used ink cartridge 40 for reuse, the insides of the ink bag 42 and ink delivery tube 43 must first be cleaned. Next, a dispenser is used to refill the ink bag 42 with a prescribed amount of ink. Then, the old data stored in the storage unit 125 of the ink cartridge 40 indicating the residual ink quantity before the ink cartridge 40 was cleaned and refilled is overwritten by using a storage device by data indicating the quantity of ink dispensed during the refilling operation. This completes the process to recycle the ink cartridge 40.

With the inkjet printer 1 according to the embodiment described above, when the ink cartridge 40 is mounted in its corresponding mounting unit 150, the controller 90 calculates, as the moving time, a length of time (t2-t1) taken by the magnetic sensor output changes from the first prescribed value Out1 to the second prescribed value Out2. When the output of the magnetic sensor 66 is Out1, the detected portion 62*c* is positioned at the first position X1 in the tube 44. When the output of the magnetic sensor 66 is Out2, the detected portion 62*c* is positioned at the second position X2 in the case 41. The distance between the first position X1 and the second position X2 in the main scanning direction is the fixed value (X2-X1). By calculating the time (t2-t1) as the moving time which was taken by the ink cartridge 40 to move by the distance (X2-X1), it is possible to determine how fast the ink cartridge 40 was mounted in the mounting unit 150. For example, if the ink cartridge 40 is mounted slowly, the moving time will be long, resulting in a small change in ink pressure during the mounting operation. On the other hand, if the ink cartridge 40 is mounted quickly, the moving time will be short, resulting in a large fluctuation in ink pressure during the mounting operation. Next, the controller 90 determines, based on the data shown in Table 1, whether the calculated moving time is less than a prescribed time, i.e., whether maintenance is required. Therefore, it is possible to ensure that maintenance is performed on the inkjet head 2 when the ink cartridge 40 is mounted in the mounting unit 150 abruptly, maintaining the ink ejection characteristics of the inkjet head 2 to a desirable state.

In addition, the storage unit 125 stores a prescribed time for each of the ink volume ranges V1-V4 as a threshold value for determining whether maintenance is required. Hence, it is possible to restrict when maintenance operations are performed on an inkier head 2 to those cases in which the moving time calculated by the controller 90 is less than the prescribed time associated with the relevant ink volume range V1-V4, thereby reducing the number of unnecessary maintenance operations. These prescribed times serving as threshold values can be increased as the quantities of ink indicated by the ink volume ranges V1-V4 grows larger. In this way, the need for maintenance on an inkjet head 2 can be more accurately determined in order to more reliably maintain the ink ejection characteristics of the inkjet head 2 at the desirable state.

With the ink cartridge 40 according to the embodiment, the maintenance unit 30 and the controller 100 for controlling the maintenance unit 30, which are provided in the printer body, can perform maintenance on an inkjet head 2 when the moving time is determined to be less than the prescribed time stored in the storage unit 125, thereby maintaining the ink ejection characteristics of the inkjet head 2 to the desirable state. Further, according to the method of recycling the ink cartridge 40 of the embodiment, the ink cartridge 40 having the above effects can be reused.

According to the present embodiment, the movement of the single detected portion 62*c* is detected by the single detecting unit 66, thereby allowing the length of time taken by the detected portion 62*c* to move by the extremely small distance (X2-X1) to be detected. Thus, the moving speed of the valve member 62 with respect to the case 41, i.e., the mounting speed of the ink cartridge 40 can be measured with accuracy.

Moreover, according to the present embodiment, the ink cartridge 40 includes only the single magnetic sensor 66 as a unit configured to measure the mounting speed of the ink cartridge 40. This simplifies the configuration of the ink cartridge 40.

As a variation of the first embodiment, the controller 100 may be used in place of the controller 90 to perform the same control operation as the controller 90. In this case, the controller 90 in the ink cartridge 40 may be omitted. Also in this point, the same effect as in the first embodiment can be obtained.

As another variation of the embodiment, the storage unit 125 may be provided in the printer body rather than in the ink cartridge 40. Further, the storage unit 125 may store different prescribed times (threshold times for determining whether maintenance is required) in association with different types of printer bodies in which the ink cartridge 40 can be used, or coefficients for multiplying the pre-stored prescribed times. More specifically, the storage unit 125 may store separate prescribed times that are shorter than reference times or a coefficient that can be used to shorten the reference times through multiplication when the length of the ink channel from the hollow needle 153 to the ejection holes formed in the inkjet head 2 is longer than a reference distance, and may store separate prescribed times longer than the reference times or a coefficient for lengthening the reference times when the ink channel is shorter than the reference distance. Further, the separate prescribed times or coefficients may be associated with the pressure resistance of the ink meniscus rather than the length of the ink channel. Specifically, the storage unit 125 could store separate prescribed times that are shorter than the reference times or a coefficient for reducing the reference times through multiplication when the ejection openings in the inkjet head 2 have a greater diameter than a reference diameter (a smaller meniscus pressure resistance than the reference pressure resistance), and separate prescribed times longer than the reference times or a coefficient for increasing the reference times when the diameter of the ejection openings is smaller than the reference diameter. Here, a controller may be suitably used to identify the type of printer and, based on the printer type, to select either the reference times or separate prescribed times, or to calculate and apply new prescribed times by multiplying the reference times by a coefficient. In addition, the storage unit 125 may store separate quantities of ink leakage associated with different printer types or coefficients for multiplying prestored quantities of ink leakage.

Second Embodiment

An inkjet printer 300 (recording device) according to a second embodiment of the present invention will be described with reference to FIG. 13 and FIG. 14.

In the inkjet printer 1 of the first embodiment, each ink cartridge 40 is directly connected to the corresponding inkjet head 2 via the tube 102.

However, according to the inkjet printer 300 of the present embodiment, a subsidiary tank 310 is provided between each ink cartridge 40 and the corresponding inkjet head 2. The subsidiary tank 310 is for separating air from ink and for establishing a pressure head difference between, the subsidiary tank 310 and the inkjet head 2.

The inkjet printer 300 of the present embodiment is the same as the inkjet printer 1 of the first embodiment except that the inkjet printer 300 is provided with ink supply systems described below and that the inkjet printer 300 operates as described below. According to the present embodiment, a Table 2 to be described later is stored in the storing unit 125 of the ink cartridge 40 instead of the Table 1. Components in the inkjet printer 300 the same as those of the first embodiment are designated with the same reference numerals to avoid duplicating description.

Next, the ink supply systems for the inkjet printer 300 will be described with reference to FIG. 13.

Similarly to the first embodiment, four ink supplying systems are provided for the four inkjet print heads 2, respectively. One of the ink supplying systems will be described below while referring to FIG. 13, but the following description is in common to the other ink supplying systems.

Figure 13:
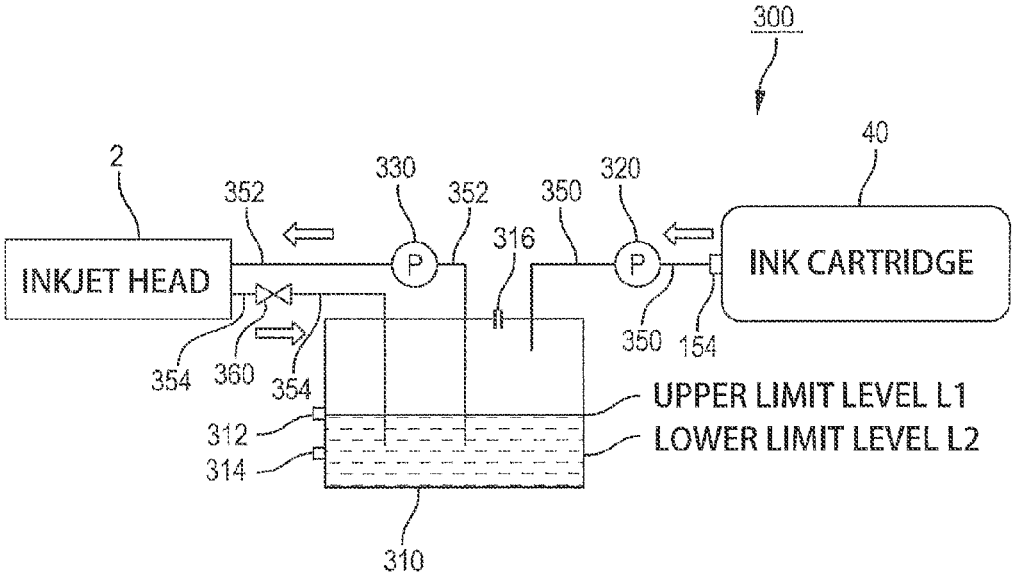
FIG. 13 is a schematic diagram showing an ink supplying system of an inkjet printer according to a second embodiment of the present invention.

As shown in FIG. 13, one subsidiary tank 310 is provided for each inkjet head 2.

In each ink supplying system, one inkjet head 2 is connected via a flexible tube 352 (ink supplying path) to one subsidiary tank 310. A purge/circulation pump 330 (ink discharging unit, ink forcibly supplying unit) is provided in the midway portion of the tube 352. The inkjet head 2 is connected also via a flexible tube 354 to the subsidiary tank 310. An open/close valve 360 is provided in the midway portion of the tube 354. The subsidiary tank 310 is connected via a flexible tube 350 (ink supplying path) to one ink supply channel 154. An ink supply pump 320 is provided in the midway portion of the tube 350. When one ink cartridge 40 is mounted in the casing 1*a* of the printer 300, the ink cartridge 40 is connected to one ink supply channel 154 so that ink can be supplied from the ink cartridge 40 via the corresponding subsidiary tank 310 to the corresponding inkjet head 2. The ink supply pump 320 is for supplying ink from the ink cartridge 40 to the subsidiary tank 310. The purge/circulation pump 330 is for forcibly supplying ink from the subsidiary tank 300 to the inkjet head 2, thereby discharging ink from the subsidiary tank 300. The purge/circulation pump 330 is also for circulating ink between the subsidiary tank 310 and the inkjet head 2. The open/close valve 360 is closed when ink is discharged from the subsidiary tank 310 through the inkjet head 2. The open/close valve 360 is opened when ink is circulated between the subsidiary tank 310 and the inkjet head 2.

The subsidiary tank 310 is formed with an opening 316. The interior of the subsidiary tank 310 is in fluid communication with atmospheric air through the opening 316. Air is separated from ink when the ink is introduced into the subsidiary tank 310. A pressure head difference within a desired range can be generated between ink in the inkjet head 2 and ink in the subsidiary tank 310 if the level of the liquid surface of the ink stored in the subsidiary tank 310 is within a prescribed range in the vertical direction, that is, if the level of the liquid surface of the ink is between a prescribed upper limit level L1 and a prescribed lower limit level L2 shown in FIG. 13. According to the present embodiment, a control is executed to maintain the level of the liquid surface of the ink within the subsidiary tank 310 at the upper limit level L1. A control is also executed, to control the liquid surface of the ink not to fall below the lower limit level L2 during a printing process even when ink in the subsidiary tank 310 is consumed by the printing process.

The subsidiary tank 310 is provided with an upper limit sensor 312 and a lower limit sensor 314, both of which are for detecting the liquid surface of ink in the subsidiary tank 310. The upper limit sensor 312 and lower limit sensor 314 are provided at the locations corresponding to the upper limit level L1 and the lower limit level L2, respectively. The upper limit sensor 312 outputs an (ON signal when the liquid surface of ink is at the same level with or at the higher level than the upper limit level L1. The upper limit sensor 312 outputs an OFF signal when the liquid surface of ink is at the lower level than the upper limit level L1. The lower limit sensor 314 outputs an ON signal when the liquid surface of ink is at the same level with or at the higher level than the lower limit level L2. The lower limit sensor 314 outputs an OFF signal when the liquid surface of ink is at the lower level than the lower limit level L2. The controller 100 is configured to receive those signals outputted from the upper limit sensor 312 and the lower limit sensor 314.

At the initial stage where ink is not yet supplied to the subsidiary tank 310, the controller 100 drives the ink supply pump 320 to supply ink from the ink cartridge 40 to the subsidiary tank 310. As ink is supplied to the subsidiary tank 310, the output signal from the lower limit sensor 314 switches from the OFF state to the ON state before the output signal from the upper limit sensor 312 switches from the OFF state to the ON state. When the output signal from the upper limit sensor 312 switches to the ON state, the controller 100 stops driving the ink supply pump 320.

The controller 100 can perform an ink discharging operation (purge operation) to forcibly eject ink from the subsidiary tank 310 through the ejecting surface 2*a* of the inkjet head 2, by driving the purge/circulation pump 330 while maintaining the open/close valve 360 in the closed state. It is noted that before performing the ink discharging operation, similarly to the maintenance process in the first embodiment, the inkjet heads 2 are moved to the retracted position and the caps 31 are moved to the capping position. According to the present embodiment, the purge/circulation pump 330 is included in the maintenance mechanism 30.

The controller 100 can also perform an ink circulating operation to circulate ink between the subsidiary tank 310 and the inkjet head 2, by driving the purge/circulation pump 330 while opening the open/close valve 360. With this ink circulating operation, air bubbles accumulated in the ink channels in the inkjet head 2 can be discharged into the subsidiary tank 310.

During the printing process, the controller 100 does not drive the ink supply pump 320 or the purge/circulation pump 330. When ink is ejected from the ejection surface 2*a* of the inkjet head 2 to perform printing operation, ink of the same amount with the ejected ink is drawn into the inkjet head 2 from the subsidiary tank 310 due to a capillary force. The controller 100 continuously checks the output signals from the upper limit sensor 312 and the lower limit sensor 314 during the printing process. As ink in the subsidiary tank 310 is consumed, the output signal from the upper limit sensor 312 switches from ON to OFF, before the output signal from the lower limit sensor 314 switches from ON to OFF. When the output signal from the lower limit sensor 314 switches from ON to OFF, the controller 100 starts driving the ink supply pump 320 to supply ink from the ink cartridge 40 to the subsidiary tank 310. When the output signal from the upper limit sensor 312 switches from OFF back to ON, the controller 100 stops driving the ink supply pump 320.

With the above described control, the liquid surface of ink in the subsidiary tank 310 is usually maintained at the upper limit level L1. During the printing process, the liquid surface of ink in the subsidiary tank 310 is maintained between the upper limit level L1 and the lower limit level L2.

When the ink cartridge 40 is mounted in the mounting unit 150, if the mounting speed is high, ink happens to flow from the ink cartridge 40 into the subsidiary tank 310. The liquid surface of ink in the subsidiary tank 310 will possibly rise and exceed the upper limit level L1, and therefore go beyond the prescribed range.

So, according to the present embodiment, the storing unit 125 provided in the ink cartridge 40 stores data of the Table 2 shown below instead of the Table 1. Similarly to Table 1, Table 2 stores data in correspondence with each of combinations of: four time ranges T1, T2, T3, and T4 for the moving time of the ink cartridge 40 and four ink volume ranges V1, V2, V3, and V4 for the ink cartridge 40. Data for each combination of the time range and the ink volume range indicates the amount of ink flowing from the ink cartridge 40 to the subsidiary tank 310 (the amount of ink flowing out of the ink cartridge) and whether ink has to be discharged from the subsidiary tank 310 to the inkjet head 2 (whether or not it is necessary to perform purging operation, that is, whether or not it is necessary to forcibly eject ink from a recording head). The concrete values of the time ranges T1, T2, T3, and T4 are the same as those in the first embodiment. That is, T1 is set to a range from 0 seconds to less than 0.2 seconds, time range T2 to a range greater than or equal to 0.2 seconds and less than 0.4 seconds, time range T3 to a range greater than or equal to 0.4 seconds and less than 0.6 seconds, and time range T4 to a range greater than or equal to 0.6 seconds. Similarly, the concrete values of the ink volume ranges V1, V2, V3, V4 are the same as those in the first embodiment. That is, ink volume range V1 is set to a range from 0 ml to less than 500 ml, ink volume range V2 to a range greater than or equal to 500 ml and less than 700 ml, ink volume range V3 to a range greater than or equal to 700 mil and less than 800 ml, and ink volume range V4 to a range greater than or equal to 800 ml and less than 1,000 ml.

TABLE 2

| | | Ink volume range | | | |
|---|---|---|---|---|---|
| | | V1 | V2 | V3 | V4 |
| Time range | T1 | Ink discharging operation not required<br>No ink inflow occurs | Ink discharging operation required<br>ink inflow occurs (ink of almost 0 ml) | Ink discharging operation required<br>ink inflow occurs (very slight amount of ink) | Ink discharging operation required<br>ink inflow occurs (some ink) |
| | T2 | Ink discharging operation not required<br>No ink inflow occurs | Ink discharging operation not required<br>No ink inflow occurs | Ink discharging operation required<br>ink inflow occurs (ink of almost 0 ml) | Ink discharging operation required<br>ink inflow occurs (very slight amount of ink) |
| | T3 | Ink discharging operation not required<br>No ink inflow occurs | Ink discharging operation not required<br>No ink inflow occurs | Ink discharging operation not required<br>No ink inflow occurs | Ink discharging operation required<br>ink inflow occurs (ink of almost 0 ml) |
| | T4 | Ink discharging operation not required<br>No ink inflow occurs | | | |

Table 2 indicates the following:

For the case where the mounted ink cartridge 40 has an ink volume falling within ink volume range V1, no ink inflow occurs from the ink cartridge to the subsidiary tank 310 and an ink discharging operation is not necessary, regardless of which time range T1-T3 the moving time (t2-t1) falls in.

For the case where the mounted ink cartridge 40 has an ink volume that falls within ink volume range V2, ink inflow with an amount of almost zero (0) ml occurs from the ink cartridge to the subsidiary tank 310 and an ink discharging operation is necessary only when the moving time falls within time range T1 (from 0 seconds to less than 0.2 seconds). In other words, an extremely tiny amount of ink may possibly flow into the subsidiary tank 310 and an ink discharging operation is necessary when the moving time is less than 0.2 seconds (prescribed time).

For the case where the mounted ink cartridge 40 has an ink volume that falls within ink volume range V3 and the moving time falls within time range T1 (from 0 seconds to less than 0.2 seconds), a very slight amount of ink flows into the subsidiary tank 310 (approximately 1 ml, for example) and an ink discharging operation is necessary. For the case where the mounted ink cartridge 40 has an ink volume that falls within ink volume range V3 and the moving time falls within time range T2 (greater than or equal to 0.2 seconds and less than 0.4 seconds), ink of almost zero (0) mil flows into the subsidiary tank 310 and an ink discharging operation is necessary. In other words, when the ink volume of the mounted ink cartridge 40 falls within ink volume range V3, an ink discharging operation is required if the moving time is less than 0.4 seconds (prescribed time), but unnecessary if the moving time is longer than or equal to 0.4 seconds.

For the case where the mounted ink cartridge 40 has an ink volume that falls within ink volume range V4, ink inflow occurs and an ink discharging operation is necessary, regardless of which time range T1-T3 the moving time falls in. A small amount of ink (some ink) flows into the subsidiary tank 310 (about 3 ml, for example) when the moving time falls within time range T1 (from 0 to less than 0.2 seconds), a very slight amount of ink flows into the subsidiary tank 310 when the moving time falls within time range T2 (greater than or equal to 0.2 seconds and less than 0.4 seconds), and ink of almost zero (0) ml flows into the subsidiary tank 310 when the moving time falls within time range T3 (greater than or equal to 0.4 seconds and less than 0.6 seconds).

The Table 2 further indicates that ink does not flow into the subsidiary tank 310 and an ink discharging operation is unnecessary when the moving time is greater than or equal to 0.6 seconds (prescribed time), that is, when the moving time falls in a time range T4, if the volume of ink in the ink cartridge 40 is less than 1,000 ml.

In this way, similarly to the first embodiment, the storing unit 250 stores, for each of the ink volume ranges V1-V4, data specifying a prescribed time (0, 0.2, 0.4, or 0.6 second) serving as a threshold for determining whether an ink discharging operation is necessary.

Similarly to Table 1, a manufacturer of the ink cartridge 40 creates the Table 2 by performing an experiment. During the experiment, the manufacturer prepares a plurality of ink cartridges 40 that are filled with ink of various volumes. The manufacturer mounts the ink cartridges 40 in the mounting unit 150 of the inkjet printer 300 at various speeds. The manufacturer measures the amount of ink flowing from each ink cartridge 40 to the subsidiary tank 310.

Figure 14:
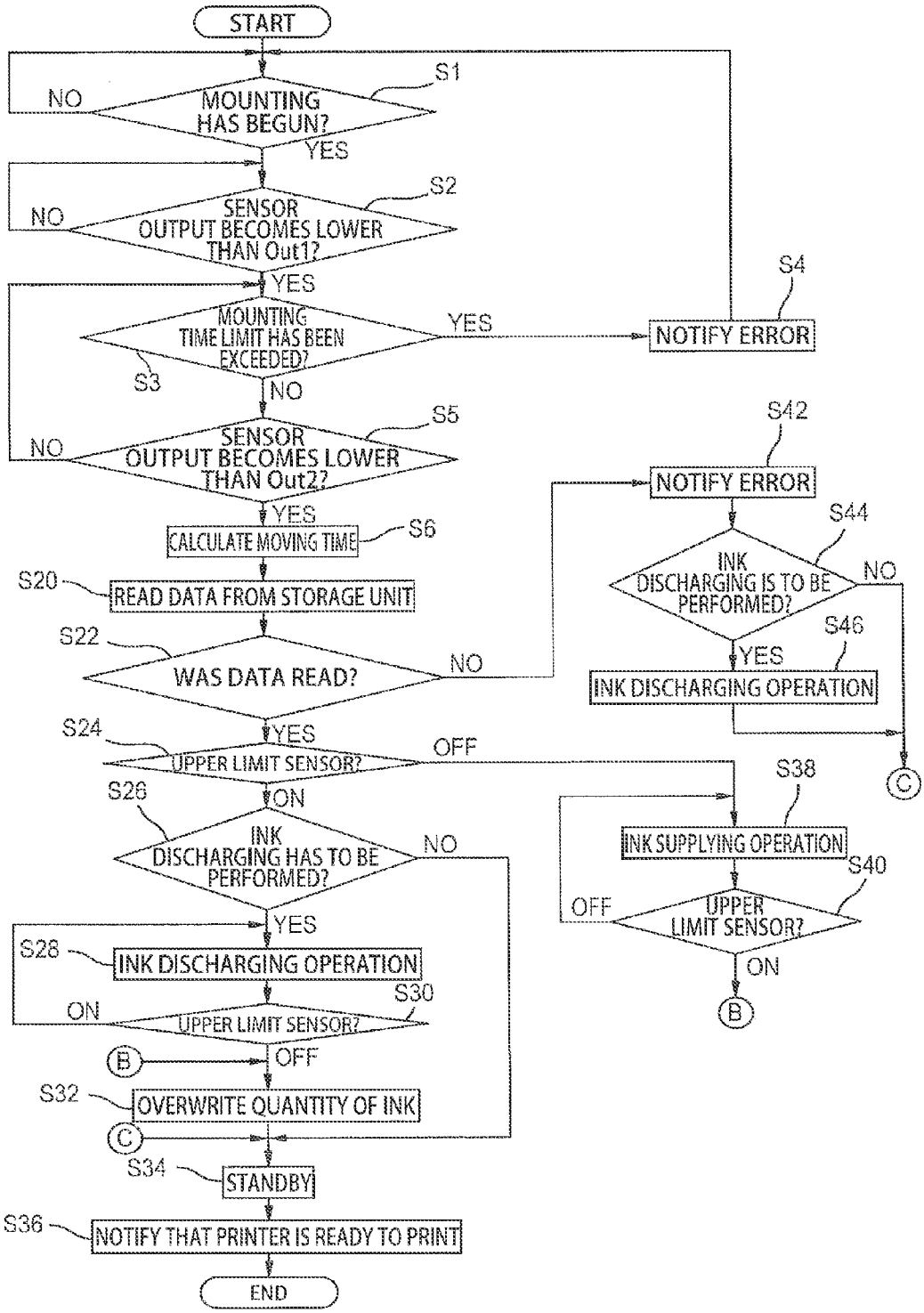
FIG. 14 is a flowchart illustrating steps in a control process according to the second embodiment when the ink cartridge is mounted in the mounting unit of the printer.

The controller 100 of the inkjet printer 300 and the controller 90 of the ink cartridge 40 execute operations as shown in FIG. 14 instead of the operations shown in FIG. 12 when an ink cartridge 40 is mounted in the mounting unit 150.

In the flowchart of FIG. 14, the processes of S1-S6 are the same as those of S1-S6 in FIG. 12.

After calculating the moving time in S6, in S20, the controller 90 reads out data of the current ink volume and data of the Table 2 stored in the storage unit 125. Next in S22, the controller 90 determines whether data was read from the storage unit 125 in S20. The process proceeds from S22 to S24 if the controller 90 determines that data was successfully read from the storage unit 125.

In S24, the controller 100 checks whether the output signal from the upper limit sensor 312 is ON or OFF.

If the output signal from the upper limit sensor 312 is ON (ON in S24), the controller 100 informs the controller 90 that the upper limit sensor 312 is ON. Next, in S26, the controller 90 determines within which of the time ranges T1, T2, T3, and T4 the moving time calculated in S6 falls, determines within which of the ink volume ranges V1, V2, V3, and V4 the volume of ink in the mounted ink cartridge 40 falls, and determines whether an ink discharging operation to discharge ink from the subsidiary tank 310 has to be performed for the newly mounted ink cartridge 40 by referring to the Table 2. In other words, the controller 90 compares the moving time for the current ink cartridge 40 with the prescribed time indicating the threshold for determining whether an ink discharging operation is required with respect to the ink volume range (V1, V2, V3, or V4), within which the ink volume in the currently mounted ink cartridge 40 falls, and determines whether the moving time is shorter than the prescribed time.

If the controller 90 determines that an ink discharging operation is required (S26: YES), in S28 the controller 90 outputs a signal to the controller 100 requesting that an ink discharging operation be started. Upon receiving this signal, the controller 100 performs the ink discharging operation by driving the purge/circulation pump 330 for a prescribed period of time while the open/close valve 360 is in the closed state. It is noted that the controller 100 starts driving the purge/circulation pump 330 after moving the inkjet heads 2 to the retracted position and moving the caps 31 to the capping position, similarly to S10 (maintenance process) in the first embodiment. In this way, ink is discharged from the subsidiary tank 310 via the inkjet head 2 (ink discharging operation).

Next, in S30, the controller 100 checks whether the output signal from the upper limit sensor 312 turns from ON to OFF. If the output signal from the upper limit sensor 312 maintains ON (ON in S30), the process returns to S28, and the controller 100 continues the ink discharging operation. When the output signal from the upper limit sensor 312 turns from ON to OFF (OFF in S30), it is known that the liquid surface of ink in the subsidiary tank 310 has declined to reach the upper limit level L1. So, the controller 100 stops driving the purge/circulation pump 330, returns the caps 31 to the initial position and returns the inkjet heads 2 to the printing position, and notifies the controller 90 that the ink discharging operation is complete. Then, the process proceeds to S32.

In S32, the controller 90 overwrites the quantity of ink stored in the storage unit 125. More specifically, the controller 90 first determines whether the ink inflow amount is "ink of almost zero (0) ml," a "very slight amount of ink," or "some ink," by referring to the Table 2. In other words, by referring to Table 2, the controller 90 determines which of "ink of almost zero (0) ml," a "very slight amount of ink," or "some ink" is the ink inflow amount that corresponds to a combination of: an ink volume range (either one of V1-V4), in which the ink quantity stored in the storage unit 125 falls; and a time range (either one of T1-T4), in which the moving time (t2-t1) calculated in S6 falls. Next, the controller 90 subtracts this determined quantity of flowing ink from the quantity of ink stored in the storage unit 125, and updates the ink quantity in the storage unit 125 with the result. Next, the process advances to S34 and enters a standby state, i.e., a print-ready state.

Next, in S36 the controller 90 outputs a signal to the controller 100 indicating that the ink cartridge 40 is print-ready. After receiving this signal, the controller 100 controls the buzzer 13 to emit a sound for notifying the user that the printer 300 is ready to print, and the operation for mounting the ink cartridge 40 is complete. The operation for updating the ink quantity of the ink cartridge 40 described in S32 may instead be performed after the operation in S36 and before the controller 100 begins a printing operation.

In the other hand, if it is determined in S26 that an ink discharging operation is not necessary (no in S26), the process proceeds from S26 directly to S34.

If the output from the upper limit sensor 312 is OFF in S24 (OFF in S24), the process proceeds to S38. In S38, the controller 100 drives the ink supply pump 320 to supply ink from the ink cartridge 40 to the subsidiary tank 310. Next, in S40, the controller 100 checks whether the output from the upper limit sensor 312 turns ON. If the output from the upper limit sensor 312 maintains OFF (OFF in S40), the process returns to S38, and the controller 100 continues the ink supplying operation. When the output from the upper limit sensor 312 turns ON (ON in S40), the controller 100 stops driving the ink supply pump 320, notifies the controller 90 that the ink supply is complete, and the process proceeds to S32. When executing the process of S32 after executing the ink supply process of S38, the controller 90 overwrites the quantity of ink stored in the storage unit 125 by subtracting the quantity of ink expended in the ink supplying operation from the quantity of ink stored in the storage unit 125, and updates the ink quantity in the storage unit 125 with the result.

On the other hand, if the controller 90 was unable to read data because the data is not stored in the storage unit 125 (S22: NO), then the controller 90 outputs an error signal to the controller 100 and, upon receiving this error signal, the controller 100 controls the buzzer 13 in S42 to emit a sound alerting the user of a problem with the storage unit 125. Then, the process proceeds from S42 to S44.

In S44, the controller 100 controls the buzzer 13 to emit a sound asking the user whether to or not to perform an ink discharging operation. If the user inputs, to the manipulation unit (not shown), his/her instruction to perform an ink discharging operation (yes in S44), the process proceeds to S46, in which an ink discharging operation is executed in the same manner as in S28. Then, the process proceeds to S34. If the user inputs his/her instruction not to perform an ink discharging operation (no in S44), the process proceeds from S44 directly to S34.

With the above-described configuration, if the ink cartridge 40 is mounted in the mounting unit 150 at a high speed and therefore ink flows from the ink cartridge 40 into the subsidiary tank 310 and the liquid surface level of the ink in the subsidiary tank 310 exceeds the upper limit level L1, the ink discharging operation is executed to discharge ink from the subsidiary tank 310 to return the liquid surface level back to the upper limit level L1. So, the negative pressure applied to the ink within the nozzles in the inkjet head 2 can be maintained in the desired range. So, the inkjet head 2 can maintain desirable ink ejection characteristics. The ink discharging operation is not executed when the ink cartridge 40 is mounted at a low speed. So, ink is not consumed in vain.

Modifications

In a variation of the second embodiment, the controller 100 may be used in place of the controller 90 to perform the same control operations as the controller 90. In this case, the controller 90 may be eliminated from the ink cartridge 40, despite which the same effects described in the second embodiment can be obtained.

As another variation of the present embodiment, the storage unit 125 may be provided in the printer body rather than in the ink cartridge 40. Further, the storage unit 125 may store different prescribed times (threshold times for determining whether an ink discharging operation is required) in association with different types of printer bodies in which the ink cartridge 40 can be used, or coefficients for multiplying the pre-stored prescribed times. More specifically, the storage unit 125 may store separate prescribed times that are shorter than reference times or a coefficient that can be used to shorten the reference times through multiplication when the length of the ink channel from the hollow needle 153 to the subsidiary tank 310 is longer than a reference distance, and may store separate prescribed times or a coefficient for lengthening the reference times when the ink channel is shorter than the reference distance. Here, a controller may be suitably used to identify the type of printer and, based on the printer type, to select either the reference times or separate prescribed times, or to calculate and apply new prescribed times by multiplying the reference times by a coefficient. In addition, the storage unit 125 may store separate ink flowing quantities associated with different printer types or coefficients for multiplying pre-stored ink flowing quantities.

While the invention has been described in detail with reference to specific embodiments thereof, various modifications may be made within the scope of the attached claims.

For example, the first valve 50 may have a structure different from that described in the embodiments, provided that the first valve 50 is disposed in the ink delivery tube 43 and can be selectively moved between an open state for allowing communication in the ink delivery tube 43 and a closed state for interrupting communication in the ink delivery tube 43.

The second valve 60 may also have a different structure than that described in the embodiments, provided that the second valve 60 is disposed in the ink delivery tube 43 between the ink bag 42 and the first valve 50 and can be selectively changed between an open state for allowing communication in a channel of the ink delivery tube 43 extending from the ink bag 42 to the first valve 50 and a closed state for interrupting communication along this channel based on the insertion of the hollow needle 153.

Moreover, one of the first and second valves 50 and 60 may be omitted.

For example, in place of the second valve 60, a moving body that moves in response to the insertion of the hollow needle 153 may be provided in the ink channel 43*a*. Movement of the moving body is detected by the magnetic sensor 66. It is preferable that the movement of the moving body is restricted within a prescribed range and that the moving body is biased by a biasing member in a direction opposite to the insertion direction of the hollow needle 153. For example, the valve seat 61 may be removed from the second valve 60 so as not to allow the second valve 60 to function as a valve but to allow the second valve 60 to serve only as a moving body. However, in this case, reliability of the first valve 50 needs to be high enough to prevent the ink from leaking outside.

Figure 15A:
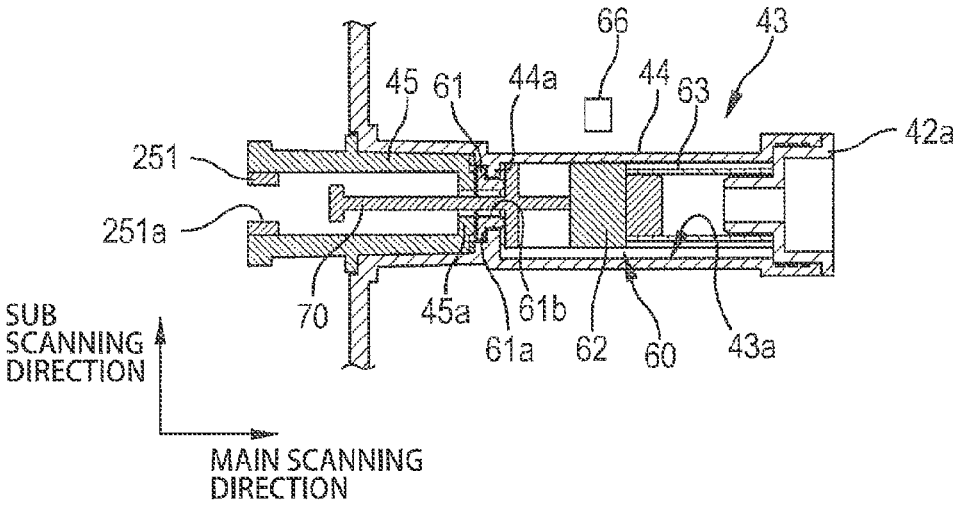
Figure 15B:
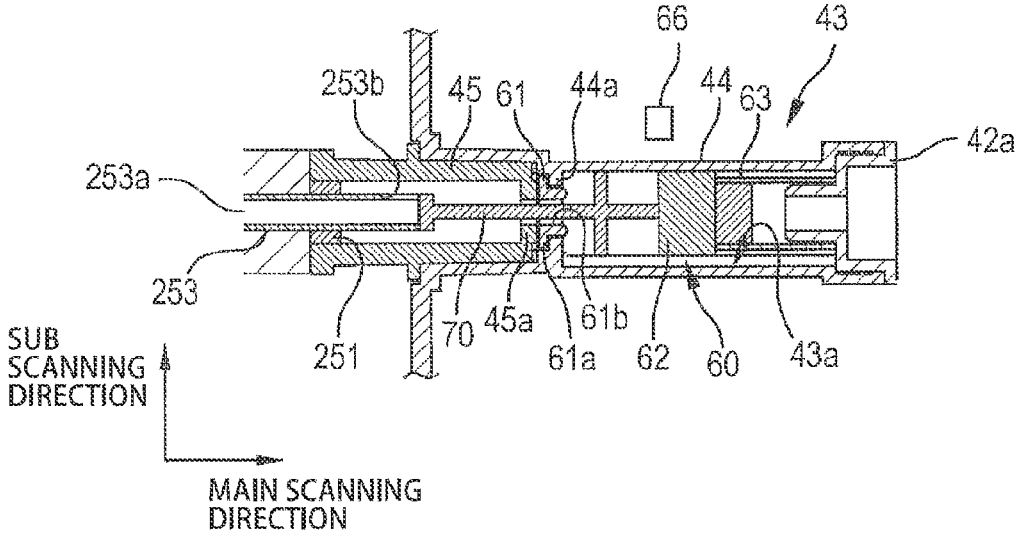

Alternatively, the first valve 50 (sealing member 51) may not be provided and, instead, as illustrated in FIG. 15(A), an elastic member 251 may be provided inside the opening of the tube 45 (ink delivery opening). The elastic member 251 has an annular shape and has, at its center, a hole 251*a* penetrating therethrough in the main scanning direction. The elastic member 251 is formed of, e.g., rubber. As illustrated in FIG. 15(B), in place of the hollow needle 153, a hollow tube 253 (hollow tube, moving unit) having a larger outer diameter than that of the hollow needle 153 is provided in the mounting unit 150. The hollow tube 253 has a hollow portion 253*a* communicating with the ink supply channel 154 and an opening portion 253*b* that makes the hollow portion 253*a* communicate with the outside of the hollow tube 253. The opening 253*b* is formed on the distal end of the hollow tube 253 at its part in the circumferential direction. The outer diameter of the hollow tube 253 is slightly larger than a diameter of the hole 251*a*. When the ink cartridge 40 is mounted to the mounting unit 150, the hollow tube 253 penetrates through the hole 251*a* of the elastic member 251. At this time, the elastic member 251 is elastically deformed such that its inner peripheral surface is tightly fitted to an outer peripheral surface of the hollow tube 253. Thus, the ink does not leak from between the elastic member 251 and hollow tube 253.

Moreover, although the detected portion 62*c* is formed of a magnet, and the movement of the detected portion 62*c* is detected using the magnetic sensor 66 in the above embodiments, a sensor other than the magnetic sensor may be used to detect the movement of the detected portion 62*c*.

For example, the detected portion 62*c* is formed of, in place of the magnet, substantially a columnar member having a mirror surface on its outer peripheral surface. In this case, all the parts (valve body 62*a*, connecting portion. 62*b*, detected portion 62*c*, and spring attachment portion 62*d*) constituting the valve member 62 and pressing member 70 can be integrally formed of a non-magnetic body (e.g., resin). Moreover, the tubes 44 and 45 are each formed of a transparent non-magnetic body (e.g., resin). Moreover, a photosensor is provided in place of the magnetic sensor 66. As the photosensor, a reflective-type optical sensor having a light-emitting element and a light-receiving element is used. As is the case with the magnetic sensor 66, the photosensor 66 is disposed in the case 41 as being separate away from the tube 44 in the sub-scanning direction and as being positioned at a prescribed position defined along the tube 44 in the main scanning direction. The prescribed position is a location at which intensity of light reflecting from the detected portion 62*c* is maximum in the initial state (FIGS. 7(A) and 8(A)) where the valve body 62*a* is seated on the valve seat 61. Therefore, an output of the photosensor is maximum (100%) in the initial state where the second valve 60 is closed. Moreover, a relationship between the position X of the detected portion 62*c* in the main scanning direction and photosensor output in the present modification is substantially the same as the relationship (FIG. 9(A)) between the position X of the detected portion 62*c* in the main scanning direction and output of the magnetic sensor 66. Thus, as in the case where the magnetic sensor 66 is used, the movement of the valve body 62 can be detected by using the photosensor. As the photosensor, not only the reflective-type photosensor, but also a transmissive-type photosensor, for example, can be used.

The casing 1*a* may also be provided with a display for providing notifications to the user in place of the buzzer 13 by displaying images rather than emitting sound. Alternatively, both notification devices (the buzzer and display) may be used in concert.

Figure 16:
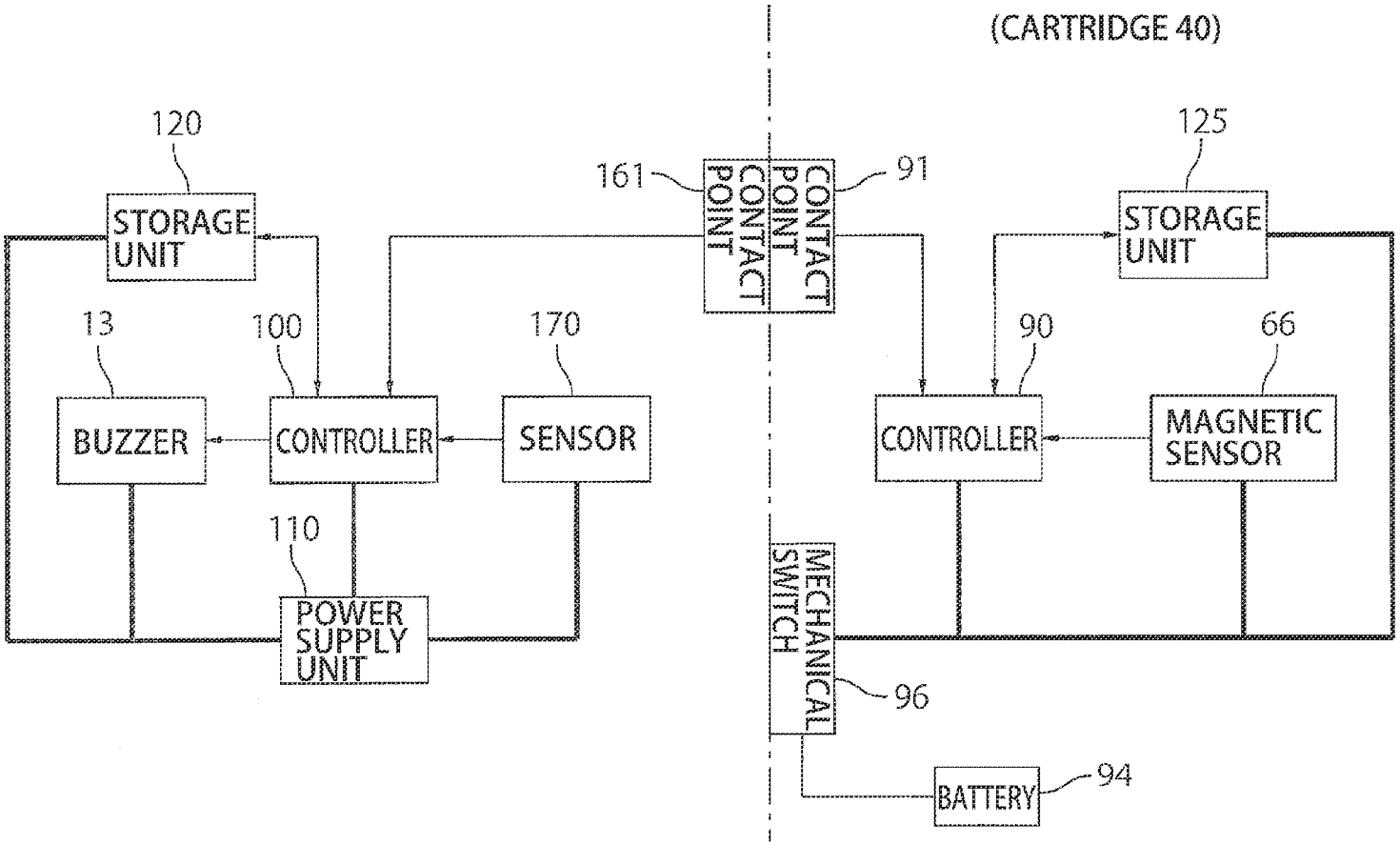
FIG. 16 is a block diagram showing the electrical structure of an inkjet printer and an ink cartridge according to another modification.

In the first and second embodiments described above, power is supplied to internal components of the ink cartridge (the magnetic sensor 66, controller 90, etc.) by mounting the ink cartridge in the printer body. However, as shown in FIG. 16, a battery 94 may be provided in the ink cartridge in place of the power input unit 92 and a mechanical switch 96 may be provided in the ink cartridge for regulating the supply of power from the battery 94 to the components. In this case, the mechanical switch 96 contacts the surface of a wall forming the recessed part 151 of the mounting unit 150 when the ink cartridge is mounted in the mounting unit 150, enabling the supply of power from the battery 94 to the internal components of the ink cartridge. This supply of power to the internal components is halted when the mechanical switch 96 separates from the wall surface. It is preferable that the mechanical switch 96 be configured such that power is supplied from the battery 94 to the internal components of the ink cartridge at the same timing that the power input unit 92 and power output part 162 become electrically connected. In this way, the same effects described in the first and second embodiments can be obtained.

What is claimed is:

1. An ink cartridge comprising:

a case;

an ink accommodating unit provided in the case and configured to accommodate ink therein;

a moving body configured to move relative to the case;

a single detecting unit provided to the case and configured to output a signal corresponding to a position of the moving body relative to the case, the detecting unit configured to output a signal indicative of a first prescribed value when the moving body reaches a first position and output a signal indicative of a second prescribed value when the moving body reaches a second position, the first position and the second position being defined in the case, the second position being different from the first position, the second prescribed value being different from the first prescribed value; and a storing unit in which is stored time length data indicative of a prescribed length of time between when the value of the signal reaches the first prescribed value and between when the value of the signal reaches the second prescribed value, the prescribed length of time corresponding to a prescribed moving speed of the moving body relative to the case.

2. The ink cartridge as claimed in claim 1, wherein only the single detecting unit is provided to the case as a unit configured to detect the moving body.

3. A recording device as claimed in claim 1, wherein the case is provided with an ink delivery path that has an ink delivery opening at one end and that is in fluid communication with the ink accommodating unit at another end; and the moving body is provided in the ink delivery path such that the moving body is movable in the ink delivery path, the moving body being configured to move by being pushed by a hollow tube that is configured to enter the ink delivery path from the ink delivery opening to take up ink, the ink delivery path is provided with a valve seat, the moving member has a valve body, the value of the signal is a prescribed initial value when the valve body is seated on the valve seat, and changes from the prescribed initial value through the first prescribed value to the second prescribed value in this order in succession as the moving body moves as being pushed by the hollow tube.

4. The ink cartridge as claimed in claim 1, wherein the moving body is configured to move along a moving path extending in a prescribed moving direction, the moving body includes a magnet, the detecting unit includes a magnetic sensor configured to detect magnetic flux generated by the magnet, the magnetic sensor is disposed at a position separate away from a prescribed position in a prescribed direction, the prescribed position being defined in the moving path, the prescribed direction being orthogonal to the prescribed moving direction, the case further includes an attitude maintaining structure configured to maintain an attitude of the magnet to such an attitude that a magnetic pole of the magnet is directed to the prescribed direction.

5. The ink cartridge as claimed in claim 1, wherein the detecting unit comprises a photosensor.

6. A recording device comprising:

a recording head configured to eject ink therefrom;

an ink cartridge;

a mounting unit configured such that the ink cartridge is detachably mounted thereto;

the ink cartridge comprising:

a case;

an ink accommodating unit provided in the case and configured to accommodate ink therein;

a moving body configured to move relative to the case; and a single detecting unit provided to the case and configured to output a signal corresponding to a position of the moving body relative to the case, the recording device comprising:

an ink supplying path configured to supply ink to the recording head from the ink accommodating unit in the ink cartridge that is mounted in the mounting unit, wherein the mounting unit includes a moving unit configured to move the moving body relative to the case such that the moving body reaches a first position before reaching a second position while the ink cartridge is moving relative to the mounting unit so as to be mounted in the mounting unit, the first position and the second position being defined in the case, the second position being different from the first position, the detecting unit is configured to output a signal indicative of a first prescribed value when the moving body reaches the first position and output a signal indicative of a second prescribed value when the moving body reaches the second position, the second prescribed value being different from the first prescribed value, the recording device further comprises:

a storing unit in which is stored time length data indicative of a prescribed length of time between when the value of the signal reaches the first prescribed value and when the value of the signal reaches the second prescribed value, the prescribed length of time corresponding to a prescribed moving speed of the ink cartridge relative to the mounting unit;

a calculating unit configured to calculate an actual length of time between when the value of the signal reaches the first prescribed value and when the value of the signal reaches the second prescribed value while the ink cartridge is actually being mounted in the mounting unit, the actual length of time corresponding to an actual moving speed that is actually attained by the ink cartridge relative to the mounting unit;

a comparing unit configured to compare the calculated actual length of time with the prescribed length of time indicated by the stored time length data;

an ink discharging mechanism configured to forcibly eject ink from the recording head; and a control unit configured to control the ink discharging mechanism based on a comparing result by the comparing unit.

7. A recording device as claimed in claim 6, wherein a subsidiary tank is provided in the ink supplying path, the subsidiary tank being configured to store ink supplied from the ink cartridge, the ink discharging unit includes an ink forcibly supplying unit configured to forcibly supply ink from the subsidiary tank to the recording head, and the control unit is configured to determine whether or not to drive the ink forcibly supplying unit based on the comparing result by the comparing unit.

* * * * *